US010723494B2

(12) United States Patent
Kobayashi et al.

(10) Patent No.: US 10,723,494 B2
(45) Date of Patent: Jul. 28, 2020

(54) PAPER SHEET BUNDLING APPARATUS

(71) Applicant: GLORY LTD., Himeji-shi, Hyogo (JP)

(72) Inventors: Kiyoaki Kobayashi, Hyogo (JP); Toshihiko Kobayashi, Hyogo (JP); Yoshikatsu Mizushima, Hyogo (JP); Hitoshi Kobayashi, Hyogo (JP); Takahiko Taguchi, Hyogo (JP); Masao Okamura, Hyogo (JP); Atsushi Nagase, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 561 days.

(21) Appl. No.: 15/125,300

(22) PCT Filed: Apr. 7, 2015

(86) PCT No.: PCT/JP2015/001964
§ 371 (c)(1),
(2) Date: Sep. 12, 2016

(87) PCT Pub. No.: WO2015/155987
PCT Pub. Date: Oct. 15, 2015

(65) Prior Publication Data

US 2017/0073095 A1 Mar. 16, 2017

(30) Foreign Application Priority Data

Apr. 9, 2014 (JP) ..... 2014-080144
Jul. 30, 2014 (JP) ..... 2014-154402

(51) Int. Cl.
*B65B 27/08* (2006.01)
*G07D 11/16* (2019.01)
(Continued)

(52) U.S. Cl.
CPC ..... *B65B 27/08* (2013.01); *B65B 13/12* (2013.01); *B65B 13/187* (2013.01); *B65B 57/00* (2013.01); *G07D 11/16* (2019.01)

(58) Field of Classification Search
CPC ..... B65B 13/02; B65B 57/02; B65B 27/08; G07D 11/16
(Continued)

(56) References Cited

U.S. PATENT DOCUMENTS 4,154,158 A 5/1979 Leslie et al.
4,938,009 A 7/1990 Takami
(Continued)

FOREIGN PATENT DOCUMENTS

CN 102348604 A * 2/2012 ..... G07D 11/0021
DE 195 00 085 A1 7/1996
(Continued)

OTHER PUBLICATIONS

JP-2008201455-A, Suzuki, Morio, Full Machine Translation (Year: 2008).*
(Continued)

*Primary Examiner* — Elaine Gort
*Assistant Examiner* — Christopher B Wehrly
(74) *Attorney, Agent, or Firm* — Renner, Kenner, Greive, Boback, Taylor & Weber

(57) ABSTRACT

A paper sheet bundling apparatus includes: a reel unit, in which a tape roll is set, configured to rotate the tape roll in a direction in which the tape is fed, and a direction in which the tape is wound; a tape transport unit, having a transport path provided between the reel unit and a tape bundling unit, configured to transport the tape, along the transport path, to supply the tape to the tape bundling unit when the tape bundling unit performs bundling, and to cause, when the tape bundling unit does not perform bundling, the tape to be
(Continued)

in a stand-by state in which the tape is arranged continuously along the transport path; and specific operation execution means for executing, at a predetermined time, a specific operation of reducing tensile force in the tape arranged continuously along the transport path, when the tape bundling unit does not perform bundling.

18 Claims, 16 Drawing Sheets

(51) Int. Cl.
*B65B 13/12* (2006.01)
*B65B 57/00* (2006.01)
*B65B 13/18* (2006.01)

(58) Field of Classification Search
USPC ..... 100/4
See application file for complete search history.

(56) References Cited

U.S. PATENT DOCUMENTS

2014/0260120 A1* 9/2014 Okamoto ..... B65H 39/10 53/540
2015/0014469 A1 1/2015 Iwatsuki

FOREIGN PATENT DOCUMENTS

| | | | |
|---|---|---|---|
| EP | 1 555 206 | A1 | 7/2005 |
| JP | 48-92380 | U | 11/1973 |
| JP | 56-48911 | A | 5/1981 |
| JP | 59-1319 | A | 1/1984 |
| JP | 59-74015 | A | 4/1984 |
| JP | 61-40302 | U | 3/1986 |
| JP | 3-84707 | U | 8/1991 |
| JP | 11-105837 | A | 4/1999 |
| JP | 2002-80012 | A | 3/2002 |
| JP | 2005-329977 | A | 12/2005 |
| JP | 2008-201455 | A | 9/2008 |
| JP | 2010-247842 | A | 11/2010 |
| JP | 2012-240728 | A | 12/2012 |
| WO | WO 2010/103619 | A1 | 9/2010 |

OTHER PUBLICATIONS

JP-61040302-U, Full Machine Translation (Year: 1986).*
CN-102348604-A, Tomoyasu Sato, Machine Translation (Year: 2012).*

* cited by examiner (A)

(B)

PAPER SHEET BUNDLING APPARATUS

TECHNICAL FIELD

The techniques disclosed herein relate to paper sheet bundling apparatus that bundle stacked paper sheets.

BACKGROUND ART

Patent Literature 1 discloses paper sheet bundling apparatus in which a plurality of small bundles each having a plurality of paper sheets stacked and bundled, are stacked and bundled, by a tape, into a large bundle. This apparatus includes a bundling unit for forming the tape into a tape loop, and allows a person to manually insert, in the formed tape loop, the large bundle having the small bundles stacked, to bundle the paper sheets. The tape to be supplied to the bundling unit is rolled so as to be roll-shaped, and the tape roll is set at a predetermined position in the paper sheet bundling apparatus. The tape drawn from the tape roll is supplied through a predetermined transport path to the bundling unit.

CITATION LIST

Patent Literature

[PTL 1] Japanese Laid-Open Patent Publication No. 2010-247842

SUMMARY OF THE INVENTION

Problems to be Solved by the Invention

Unlike in the bundling apparatus disclosed in Patent Literature 1, in order to immediately perform a subsequent bundling operation, when bundling of paper sheets is not performed, the tape drawn from the tape roll may be in a stand-by state in which the tape is continuously arranged along the transport path such that the leading end of the tape is positioned at a predetermined position near the bundling unit. Tensile force may be applied to the tape in the stand-by state so as to generate no slack such that a tape feeding amount is accurately grasped in the subsequent bundling operation.

However, in such a structure, although the subsequent bundling operation can be immediately performed with accuracy, deformation such as torsion or bending of the tape is likely to be generated while the tape is in the stand-by state (in the description herein, the stand-by state includes not only a state where bundling of the paper sheets is not performed when the power supply for the paper sheet bundling apparatus is on, but also a state where the power supply for the paper sheet bundling apparatus is off). When the tape is formed into a tape loop in order to perform the subsequent bundling operation, the deformation generated in the tape may cause various troubles.

As a specific example, the malfunction described below is likely to occur. That is, in the bundling apparatus disclosed in Patent Literature 1, an inner-side loop guide that includes a loop inner-side wall surface and an outer-side loop guide that includes a loop outer-side wall surface form a transport path for transporting the tape such that the tape is formed into a tape loop, and, when the paper sheets are bundled, the inner-side loop guide is retracted. Unlike this, in a structure in which a small tape loop is firstly formed, the tape is fed so as to enlarge the tape loop, and the tape loop is formed, by a guide portion for guiding the outer circumference side portion of the tape, so as to have a predetermined shape and a predetermined size by which the paper sheets can be inserted therein, the inner-side loop guide may not be provided, and the retracting mechanism thereof need not be provided, thereby simplifying the structure. In this structure, a light-shielding sensor or the like may detect that a tape loop having a predetermined shape and a predetermined size has been formed. In the structure in which the detection is performed by the sensor or the like, in a case where deformation is generated in the tape, the tape loop having the predetermined shape and the predetermined size cannot be formed and the light-shielding sensor cannot detect the tape when the tape loop is formed, or the tape that has deformation may be prevented from being detected by the light-shielding sensor, so that, although the tape loop having a shape that allows the paper sheets to be inserted has been formed, this cannot be detected, in some cases.

The techniques disclosed herein are made in view of the above-mentioned situation, and an object of the techniques is to provide a paper sheet bundling apparatus that avoids malfunction which may be caused by a tape having deformation.

Solution to the Problems

The technique disclosed herein is related to a paper sheet bundling apparatus, and the apparatus includes: a tape bundling unit configured to bundle stacked paper sheets with a tape; a reel unit in which a tape roll is set, the reel unit configured to rotate the tape roll in a feeding direction in which the tape is fed, and a winding direction in which the tape is wound; a tape transport unit having a transport path provided between the reel unit and the tape bundling unit, the tape transport unit configured to transport the tape drawn from the tape roll, along the transport path, to supply the tape to the tape bundling unit when the tape bundling unit performs bundling, and to cause, when the tape bundling unit does not perform bundling, the tape to be in a stand-by state in which the tape is arranged continuously along the transport path; and a specific operation execution means for executing, at a predetermined time, a specific operation of reducing tensile force in the tape arranged continuously along the transport path, when the tape bundling unit does not perform bundling.

In this configuration, when the tape bundling unit does not perform bundling with a tape, a tape drawn from the tape roll is arranged continuously along the transport path in order to immediately supply the tape to the tape bundling unit when the subsequent bundling operation is performed. Further, tensile force is preferably applied to the tape arranged continuously along the transport path so as to generate no slack such that a tape feeding amount is accurately grasped in the subsequent bundling operation.

Meanwhile, when the tape remains stationary in a state where tensile force is applied thereto, the tape may have deformation. Therefore, in the above configuration, the specific operation execution means executes, at a predetermined time, a specific operation of reducing tensile force in the tape when the tape bundling unit does not perform bundling. Thus, the tape is prevented from having deformation, and malfunction caused by the deformation generated in the tape can be avoided.

The specific operation execution means may include the reel unit, and the reel unit may reduce tensile force in the tape by performing a specific operation of rotating the tape roll in the feeding direction.

The reel unit that serve as the specific operation execution means rotates the tape roll in the tape feeding direction, whereby tensile force in the tape arranged continuously along the transport path between the reel unit and the tape bundling unit can be reduced. Slack may be generated in the tape as a result of reducing the tensile force. When the tape is supplied to the tape bundling unit in order to start the subsequent bundling operation, it is preferable that the reel unit rotates the tape roll in a winding direction in which the tape is wound, the slack of the tape is eliminated, and the tape is then supplied. Thus, an amount of tape supplied to the tape bundling unit can be accurately controlled.

Unlike this, the specific operation execution means may include the tape transport unit, and the tape transport unit may reduce tensile force in the tape by performing a specific operation of transporting the tape arranged continuously along the transport path, in a winding direction in which the tape is wound back to the reel unit.

The tape transport unit that serves as the specific operation execution means transports the tape in a winding direction in which the tape is wound back to the reel unit, whereby tensile force in the tape arranged continuously along the transport path between the reel unit and the tape bundling unit can be reduced. Similarly to the above-described case, slack may be generated in the tape. Further, in this configuration, the leading end position of the tape can be changed. When the tape is supplied to the tape bundling unit in order to start the subsequent bundling operation, it is preferable that, for example, the leading end of the tape is positioned at a predetermined position near the tape bundling unit, and the reel unit thereafter rotates the tape roll in the direction in which the tape is wound, whereby the slack of the tape is eliminated and the tape is then supplied to the tape bundling unit.

Further, a paper sheet bundling apparatus disclosed herein includes: a tape bundling unit configured to bundle stacked paper sheets with a tape; a reel unit in which a tape roll is set, the reel unit configured to rotate the tape roll in a feeding direction in which the tape is fed, and a winding direction in which the tape is wound; a tape transport unit having a transport path provided between the reel unit and the tape bundling unit, the tape transport unit configured to transport the tape drawn from the tape roll, along the transport path, to supply the tape to the tape bundling unit when the tape bundling unit performs bundling, and to cause, when the tape bundling unit does not perform bundling, the tape to be in a stand-by state in which the tape is arranged continuously along the transport path; and specific operation execution means for executing, at a predetermined time, a specific operation of changing a stand-by position of the tape arranged continuously along the transport path, when the tape bundling unit does not perform bundling.

In this configuration, when the tape bundling unit does not perform bundling of the tape, the tape drawn from the tape roll is arranged continuously along the transport path. Tensile force is preferably applied to the tape arranged continuously along the transport path so as to generate no slack such that a tape feeding amount is accurately grasped in the subsequent bundling operation. The leading end of the tape in the stand-by state is preferably positioned at a predetermined position near the tape bundling unit in order to immediately start supplying of the tape to the tape bundling unit in the subsequent bundling operation.

Meanwhile, when the tape remains stationary in a state where the leading end of the tape is at a predetermined position and tensile force is applied to the tape, a specific portion of the tape positioned between the reel unit and the tape bundling unit may have deformation. However, in the above configuration, the specific operation execution means executes, at a predetermined time, a specific operation of changing the stand-by position of the tape when the tape bundling unit does not perform bundling.

Thus, the tape is prevented from having deformation in a specific portion. This can particularly avoid occurrence of malfunction due to deformation generated in the specific portion of the tape (for example, occurrence of the tape having deformation in the specific portion being prevented from being detected by a sensor provided at a predetermined portion in the paper sheet bundling apparatus as described above).

The tape has deformation when the tape remains continuously stationary for a long time period to some degree. Therefore, the operation of changing the stand-by position of the tape is periodically performed, whereby a time period in which the tape remains continuously stationary can be shortened, thereby inhibiting the tape from having deformation.

Thus, when the tape bundling unit does not perform bundling, the specific operation of changing the stand-by position of the tape, is executed at a predetermined time, thereby avoiding occurrence of malfunction caused by deformation generated in the tape.

The specific operation execution means may execute the specific operation when a predetermined time period has elapsed in a state where the tape bundling unit does not bundle the paper sheets.

Thus, the specific operation is performed before the tape has deformation, whereby the tape or a specific portion of the tape can be prevented or inhibited from having deformation, and occurrence of the malfunction caused by deformation generated in the tape can be avoided. Meanwhile, until a predetermined time period elapses, the tape is in the stand-by state at a predetermined stand-by position in a state where tensile force is applied thereto. Therefore, at that time, when the bundling operation for the paper sheets is started, the tape can be immediately supplied to the tape bundling unit.

The specific operation execution means may execute the specific operation when the tape bundling unit has completed bundling of the paper sheets.

Thus, for the subsequent bundling operation, the tape or a specific portion of the tape can be effectively prevented or inhibited from having deformation.

The specific operation execution means may execute the specific operation when one transaction in which the tape bundling unit performs bundling of the paper sheets has ended.

Thus, although the bundling operation is sequentially performed in one transaction in some cases, the specific operation is not performed in the one transaction, whereby the tape is in the stand-by state, at a predetermined stand-by position, between the bundling operation and the bundling operation, in a state where tensile force is applied thereto. Thus, supply of the tape to the tape bundling unit can be immediately started when the bundling operation is started. Therefore, the bundling operation which can be executed once or more times in one transaction can be smoothly performed. Meanwhile, the specific operation is executed when one transaction has ended, whereby the tape or a specific portion of the tape is prevented or inhibited from having deformation even when a time period elapses before the subsequent transaction is performed.

The tape transport unit may transport the tape drawn from the tape roll, in a direction in which the tape is fed toward the tape bundling unit, when the tape roll is set in the reel unit, to arrange the tape continuously along the transport path, and the specific operation execution means may execute the specific operation when the tape roll is set in the reel unit.

When the tape roll is set in the reel unit, the tape is preferably in a stand-by state, at a predetermined stand-by position in the transport path, in a state where tensile force is applied thereto, for the bundling operation for paper sheets. Therefore, the tape transport unit transports the tape drawn from the tape roll in a direction in which the tape is fed toward the tape bundling unit, whereby the tape is arranged continuously along the transport path.

Meanwhile, a time may elapse after the tape roll is set in the reel unit until the bundling operation for paper sheets is actually performed. Therefore, the specific operation execution means executes the specific operation when the tape roll is set in the reel unit. Thus, the tape or a specific portion of the tape can be prevented or inhibited from having deformation. The tape is arranged continuously along the transport path also after the specific operation, whereby the tape can be relatively immediately supplied to the tape bundling unit when the bundling operation for the paper sheet is started.

The specific operation execution means may execute the specific operation when a power supply is switched off.

When an operation of switching off the power supply for the paper sheet bundling apparatus is performed, it is assumed that the bundling operation for paper sheets is not performed for a while after that. Therefore, it is preferable that the specific operation execution means executes the specific operation, whereby the tape or a specific portion of the tape is prevented or inhibited from having deformation. Power is supplied to the paper sheet bundling apparatus so as to execute the specific operation even after an operation of switching off the power supply is performed. For example, when the paper sheet bundling apparatus has two power supplies that are a main body power supply and an operation unit power supply, the "power supply" may be the operation unit power supply. Thus, even if the operation unit power supply is off, when the main body power supply is on, power can be supplied to the paper sheet bundling apparatus. After the power supply is switched off, stop of power supply to the paper sheet bundling apparatus may be delayed. Thus, the specific operation can be performed while the stop is delayed.

In a configuration in which the specific operation is executed when an operation of switching off the power supply of the paper sheet bundling apparatus is performed, when the power supply of the paper sheet bundling apparatus is switched on, the leading end of the tape may be positioned at a predetermined position near the tape bundling unit for the execution of the bundling operation and, at the same time, tensile force may be applied so as to eliminate slack of the tape.

The paper sheet bundling apparatus may include at least one of a sensor that detects an ambient temperature and a sensor that detects an ambient humidity, and the specific operation execution means may set the predetermined time at which the specific operation is executed, based on a result of detection by each sensor.

The tape used for bundling paper sheets has a paper layer that serves as a base for the tape, and an adhesive layer that is melt-adhered due to heat, in many cases. The paper layer and the adhesive layer can absorb moisture, whereby the tape is likely to have deformation when an ambient humidity is high or when change in humidity is great. For example, also when an ambient temperature is high or when change in temperature is great, the tape is likely to have deformation. Therefore, the specific operation execution means preferably sets a predetermined time at which the specific operation is to be executed, based on detection results from the sensor that detects a temperature and/or the sensor that detects a humidity. In a temperature environment where the tape is likely to have deformation and/or in a humidity environment in which the tape is likely to have deformation, execution of the specific operation may be promoted. For example, in a case where, as described above, the specific operation is performed when a predetermined time period has elapsed in a state where the tape bundling unit does not perform bundling of paper sheets, the predetermined time period may be shortened. Thus, according to an ambient environment, the tape or a specific portion of the tape can be effectively prevented or inhibited from having deformation.

Further, a paper sheet bundling apparatus disclosed herein includes: a tape bundling unit configured to bundle stacked paper sheets with a tape; a reel unit in which a tape roll is set, the reel unit configured to rotate the tape roll in a feeding direction in which the tape is fed, and a winding direction in which the tape is wound; a tape transport unit having a transport path provided between the reel unit and the tape bundling unit, the tape transport unit configured to transport the tape drawn from the tape roll, along the transport path, to supply the tape to the tape bundling unit when the tape bundling unit performs bundling, and to cause, when the tape bundling unit does not perform bundling, the tape to be in a stand-by state in which the tape is arranged continuously along the transport path; and correction means for correcting, before the tape is supplied to the tape bundling unit, deformation which is generated in the tape while no bundling is performed.

In this configuration, unlike in the above-described configuration, instead of preventing or inhibiting the tape or a specific portion of the tape from having deformation, deformation generated in the tape is corrected and the tape is then supplied to the tape bundling unit. Thus, the malfunction caused by the deformation generated in the tape can be avoided. "While no bundling is performed" described herein means not only while bundling of paper sheets is not performed when the power supply for the paper sheet bundling apparatus is on, but also while the power supply for the paper sheet bundling apparatus is off.

The correction means may correct deformation of the tape when bundling of paper sheets is started after a state where bundling is not performed has continued for a predetermined time period or longer period. In a case where a state where the bundling is not performed does not continue for the predetermined time period or longer period, and the bundling of the paper sheets is started, it is determined that the tape does not have deformation, and the correction means may not perform the correction.

As a method for correcting deformation generated in the tape, various methods can be adopted. An exemplary method is a method in which the tape transport unit reciprocates the tape in the transport path in the feeding direction and winding-back direction by using a guide or roller pairs that are provided so as to nip the tape in the thickness direction and thus form the transport path, whereby the deformation generated in the tape may be corrected.

In addition, a paper sheet bundling apparatus disclosed herein includes: a tape bundling unit configured to bundle stacked paper sheets with a tape; a reel unit in which a tape roll is set, the reel unit configured to rotate the tape roll in a feeding direction in which the tape is fed, and a winding direction in which the tape is wound; and a tape transport unit having a transport path provided between the reel unit and the tape bundling unit, the tape transport unit configured to transport the tape drawn from the tape roll, along the transport path, to supply the tape to the tape bundling unit when the tape bundling unit performs bundling, and to cause, when the tape bundling unit does not perform bundling, the tape to be in a stand-by state in which the tape is arranged continuously along the transport path.

The tape bundling unit forms, into a tape loop, the tape supplied by the tape transport unit, and bundles the paper sheets by inserting the stacked paper sheets into a tape loop. The tape bundling unit further includes a sensor that detects whether or not the tape loop having a predetermined shape has been formed, and the tape bundling unit forms the tape loop again when the tape loop having the predetermined shape is not formed, based on a result of detection by the sensor. The tape bundling unit further performs forming of the tape loop for a predetermined number of times regardless of a result of detection by the sensor, when starting bundling of the paper sheets after a state where bundling is not performed has continued for a predetermined time period or longer period.

In this configuration, the malfunction in which, when the tape loop has been formed, the tape is prevented from being detected by the sensor due to deformation generated in the tape, and the sensor cannot detect the tape, is overcome. The sensor detects whether or not the tape loop is formed into a predetermined shape, and the "predetermined shape" means such a desired shape as to allow paper sheets to be inserted into the tape loop and bundled. When the detection by the sensor indicates that the tape loop is not formed into the predetermined shape, the tape loop is formed again, whereby bundling of paper sheets can be assuredly performed.

Meanwhile, when detection accuracy of the sensor is reduced due to deformation generated in the tape, although the tape loop has been formed into the predetermined shape, the tape loop may be formed again due to erroneous detection by the sensor. This may cause delay in bundling operation. Further, an error may occur as a result of erroneous detection being repeated by the sensor. This may cause increased delay in bundling.

Therefore, when detection accuracy of the sensor is likely to be reduced due to deformation generated in the tape, the tape loop is formed regardless of a result of detection by the sensor. Specifically, as described above, when bundling of paper sheets is started after a state where bundling is not performed has continued for a predetermined time period or longer period, the tape bundling unit forms the tape loop regardless of a result of detection by the sensor because the tape supplied from the tape bundling unit is likely to have deformation. Thus, the tape loop is prevented from being formed again due to erroneous detection by the sensor in the case of the detection accuracy of the sensor being low, and the bundling operation for paper sheets can be immediately completed.

The tape loop is formed regardless of the detection by the sensor for a predetermined number of times. Thus, the bundling operation for paper sheets is performed for the predetermined number of times, and the predetermined number of bundles of paper sheets are obtained. That is, the predetermined number of times depends on the length of the tape arranged continuously along the transport path between the reel unit and the tape bundling unit. That is, while no bundling is performed, the deformation of the tape is generated in a portion, of the tape, arranged continuously along the transport path between the reel unit and the tape bundling unit. Therefore, the tape supplied to the tape bundling unit after the tape loop is formed for the predetermined number of times, has no deformation. The predetermined number of times may be set as appropriate according to the configuration of the apparatus and may be, for example, one or two.

Advantageous Effects of the Invention

The paper sheet bundling apparatus allows the malfunction caused by deformation generated in the tape to be avoided.

DESCRIPTION OF EMBODIMENTS

An embodiment will be described below in detail with reference to the drawings.

<Schematic Structure of Banknote Handling Apparatus>

Figure 1:
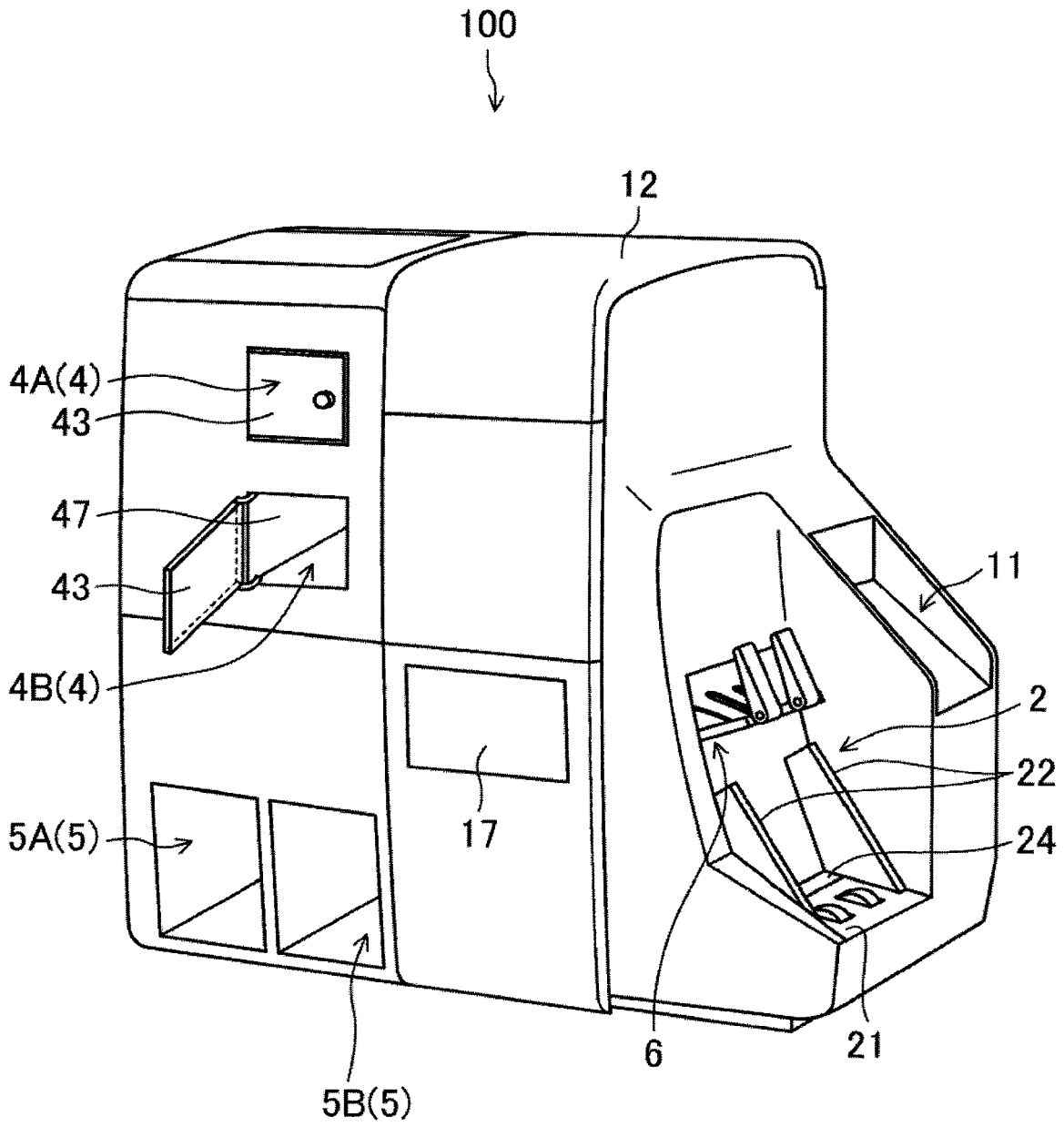
FIG. 1 is an external view of a banknote handling apparatus.
Figure 2:
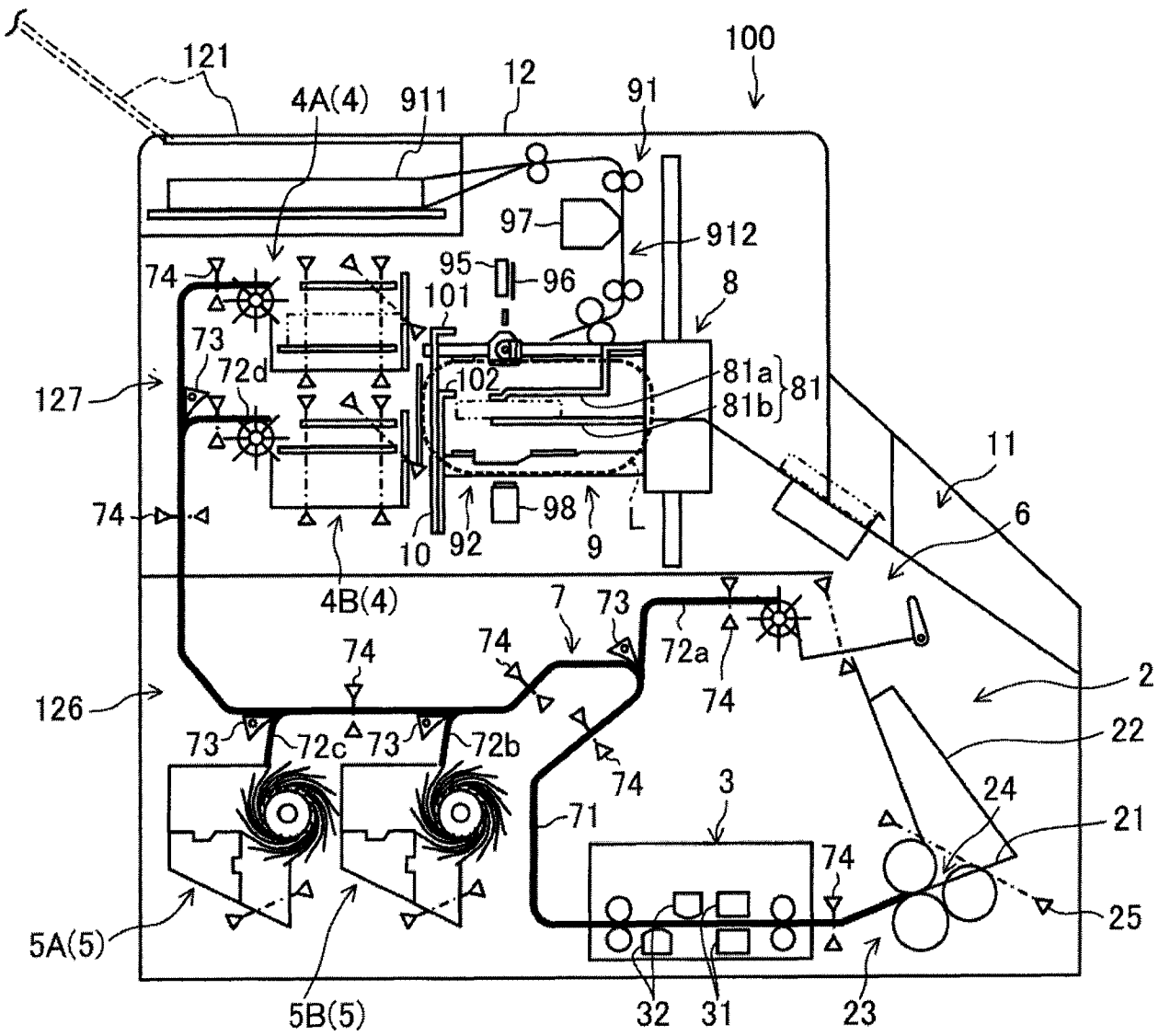
FIG. 2 illustrates a schematic structure of the banknote handling apparatus.

FIG. 1 is an external view of a banknote handling apparatus 100 as a paper sheet bundling apparatus. FIG. 2 illustrates a schematic structure of the banknote handling apparatus 100.

The banknote handling apparatus 100 is installed in, for example, a teller counter of a bank, and used by an operator. The banknote handling apparatus 100 takes in loose banknotes, stacks a predetermined kind of banknotes, bundles a predetermined number of the banknotes, and discharges the bundled banknotes.

The banknote handling apparatus 100 includes: a hopper unit 2, on which banknotes are placed, for taking in the banknotes; a recognition unit 3 that recognizes banknotes; a bundling stacker 4 that stacks banknotes to be bundled; a non-bundling stacker 5 that stacks banknotes to be not bundled; a reject stacker 6 that stacks rejected notes; a first transport unit 7 that transports the banknotes taken from the hopper unit 2 to the recognition unit 3, the bundling stacker 4, the non-bundling stacker 5, and the reject stacker 6; a second transport unit 8 that transports the banknotes stacked in the bundling stacker 4 to a predetermined position; a bundling unit 9 that bundles the banknotes transported by the second transport unit 8; a third transport unit 10 that transports the banknotes having been bundled (hereinafter, referred to as "bundled banknotes"); an outlet portion 11 by which the bundled banknotes are discharged; and a box-shaped housing 12 that accommodates the recognition unit 3, the bundling stacker 4, the non-bundling stacker 5, the reject stacker 6, the first transport unit 7, the second transport unit 8, the bundling unit 9, and the third transport unit 10.

The housing 12 is divided into a first handling unit 126 that performs handling associated with recognition and sorting of banknotes, and a second handling unit 127 that performs handling associated with bundling of banknotes to be bundled. The second handling unit 127 is disposed above the first handling unit 126. The first handling unit 126 includes the hopper unit 2, the recognition unit 3, the non-bundling stacker 5, and the reject stacker 6. The second handling unit 127 includes the bundling stacker 4, the second transport unit 8, the bundling unit 9, and the third transport unit 10. The most part of the first transport unit 7 is included in the first handling unit 126.

The bundling stacker 4 includes two stackers which are a first bundling stacker 4A and a second bundling stacker 4B. Both the first bundling stacker 4A and the second bundling stacker 4B stack banknotes to be bundled. Banknotes stacked as banknotes to be bundled can be set as appropriate.

The non-bundling stacker 5 includes two stackers which are a first and a second non-bundling stackers 5A, 5B. The first and the second non-bundling stackers 5A, 5B are aligned substantially in the horizontal direction in the first handling unit 126.

The hopper unit 2 includes: a placement table 21 on which banknotes are placed; two guide portions 22, 22 that guide the banknotes placed on the placement table 21; a taking-in roller 23; an inlet 24 through which the banknotes are taken in; and a banknote sensor 25 that detects banknotes on the placement table 21. In the present embodiment, banknotes are placed on the hopper unit 2 and taken in so as to perform short edge feed of the banknotes.

The banknote sensor 25 is disposed near the inlet 24. The banknote sensor 25 has a transmitter unit that emits light and a receiver unit that receives light. When light that is emitted from the transmitter unit and is to arrive at the receiver unit, is blocked, it is detected that the banknote is present. Passage sensors 74, a first tape sensor 9210, and a second tape sensor 9211, which will be described below, each have a similar structure. The banknote sensor 25 is positioned such that light therefrom is blocked by banknotes placed on the placement table 21. That is, the banknote sensor 25 can detect that banknotes are placed on the placement table 21, by the light being blocked.

The first transport unit 7 includes a transporting belt and the like. The first transport unit 7 has: a main transport path 71; a first to a fourth diverging paths 72*a* to 72*d* that diverge from the main transport path 71; diverter mechanisms 73 provided at portions at which the diverging paths diverge from the main transport path 71; and a plurality of passage sensors 74 each of which detects that a banknote passes. The first transport unit 7 transports the banknote so as to perform short edge feed.

The recognition unit 3 is provided upstream of the first diverging path 72*a* in the main transport path 71. The recognition unit 3 performs, one by one, recognition of the denomination, authentication, and recognition of fitness of each banknote being transported. The recognition unit 3 is formed as one unit in the banknote handling apparatus 100, which is not shown in detail, and the recognition unit 3 has a control board different from a control unit 120 that controls the entirety of the banknote handling apparatus 100. The control board includes information necessary for recognizing banknotes, and a recognition template 33 (see FIG. 5) which is referred to by the recognition unit 3 when the recognition is performed. The recognition unit 3 has a line sensor 31 and a magnetic sensor 32, and obtains characteristics of the banknotes. The recognition unit 3 determines whether or not the characteristic of each banknote conforms to the characteristic, of each kind of banknote, which is included in the recognition template 33, and performs recognition of the denomination, authentication, and recognition of fitness.

The bundling unit 9 bundles stacked banknotes. The bundling unit 9 forms a tape loop L, and winds back the tape after the banknotes have been transported into the tape loop L, to bundle the banknotes with a tape, which will be described below in detail.

The second transport unit 8 holds the banknotes stacked in the bundling stacker 4, and transports the banknotes into the tape loop L. The second transport unit 8 includes: a holding unit 81 that holds banknotes; a first horizontal movement mechanism that moves the holding unit 81 horizontally in the short edge direction of the banknotes (hereinafter, referred to as "first horizontal direction"); a second horizontal movement mechanism that moves the holding unit 81 horizontally in the long edge direction of the banknotes (hereinafter, referred to as "second horizontal direction"); and an up-down movement mechanism that moves the holding unit 81 in the up-down direction.

The holding unit 81 has: an upper arm unit 81*a*; a lower arm unit 81*b* opposing the upper arm unit 81*a*; and a holding mechanism that moves the upper arm unit 81 a in the up-down direction. The banknotes can be held by the upper arm unit 81*a* and the lower arm unit 81*b*.

The third transport unit 10 transports the bundled banknotes to the outlet portion 11. The third transport unit 10 has an upper holding unit 101, a lower holding unit 102, and a horizontal movement mechanism that moves the upper holding unit 101 and the lower holding unit 102 in the first horizontal direction.

On the side surface of the housing 12, as shown in FIG. 1, a touch panel 17 is provided. The touch panel 17 is an operation unit through which information is inputted to the banknote handling apparatus 100, and is a display unit that displays information from the banknote handling apparatus 100. The touch panel 17 serves as a human interface part to an operator who operates the banknote handling apparatus 100.

Figure 6:
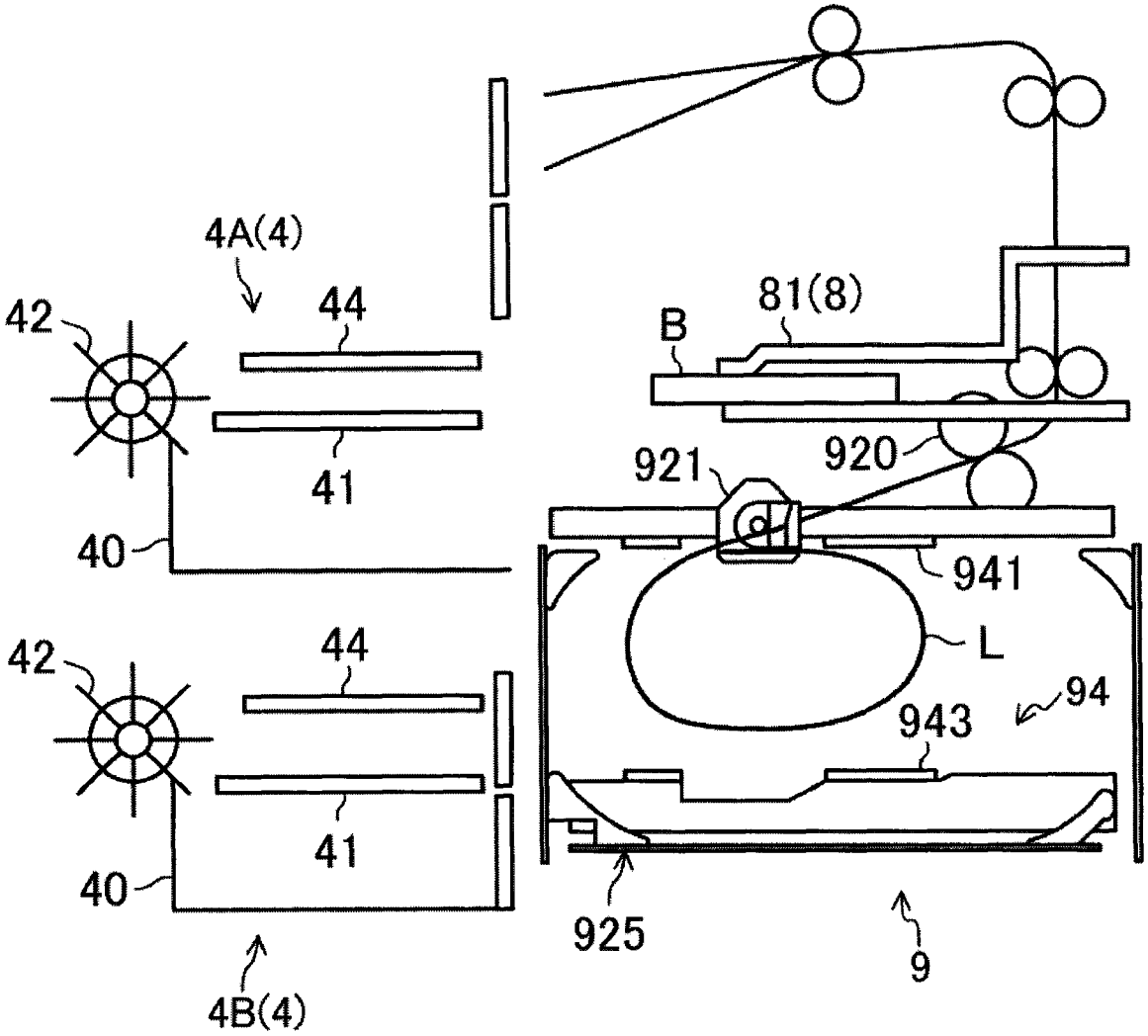
FIG. 6 illustrates a state where banknotes are extracted from a bundling stacker by a second transport unit.
Figure 7:
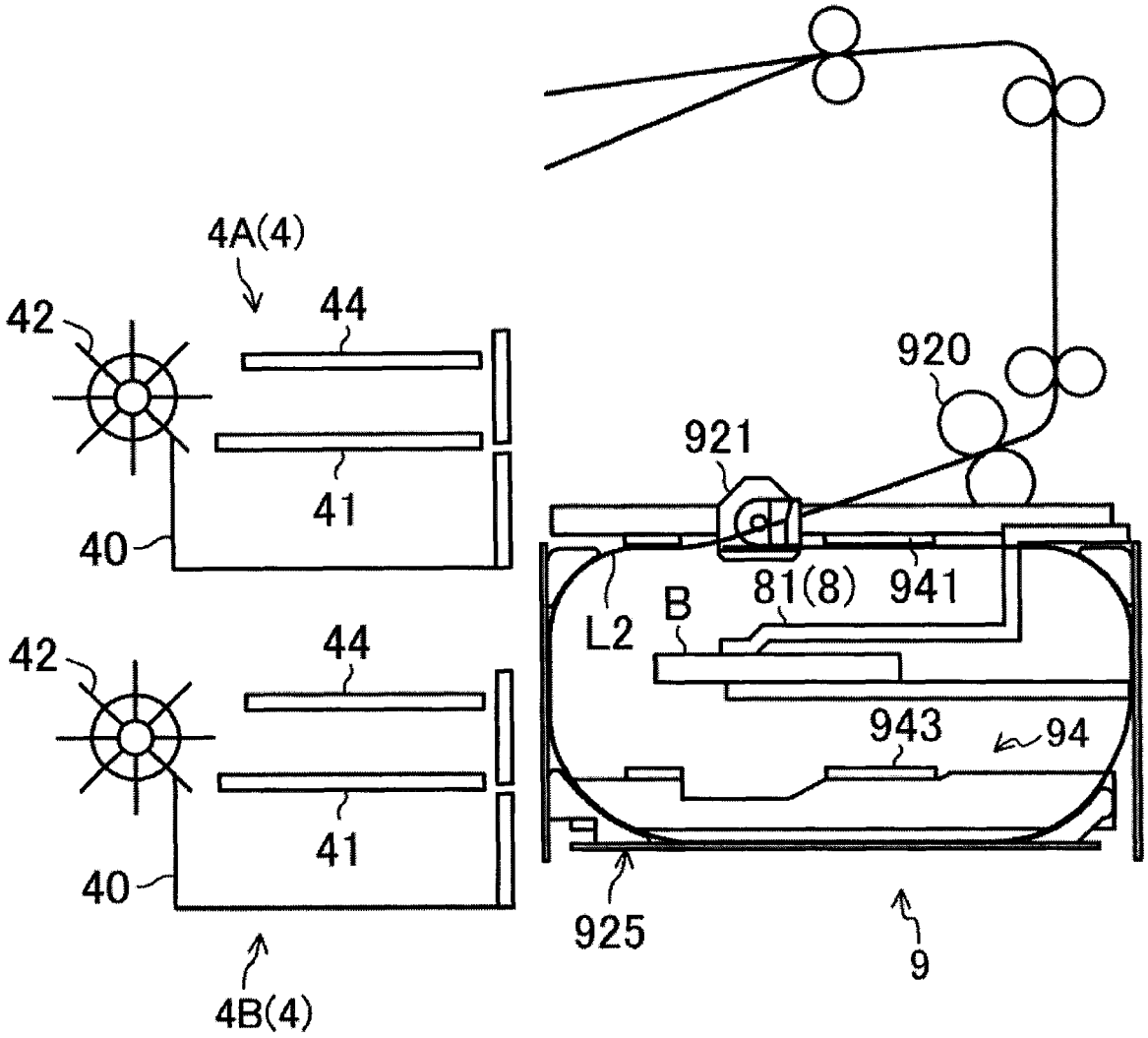
FIG. 7 illustrates a state where the second transport unit has transported banknotes to a lateral side of a tape loop.

FIGS. 6 and 7 illustrate schematic structures of the bundling stacker 4 and the bundling unit 9.

The bundling stacker 4 stacks banknotes B collectively. The bundling stacker 4 has: a container 40 in which the banknotes B are stacked; a stage 41, disposed in the container 40, on which the banknotes B are placed; a stacking wheel 42 that transports the transported banknotes B into the container 40; a door 43 (see FIG. 1) that opens and closes a first outlet 47 that is open on the side surface of the housing 12; and a top plate 44 that defines the ceiling of the container 40.

<Specific Structure of Bundling Unit 9>

The bundling unit 9 has: a tape feeding unit 91 that feeds a tape T; a tape loop forming unit 92 that forms the tape loop L with the tape T; a clamp unit 94 (see FIGS. 6, 7) that presses the banknotes B in the stacking direction when the banknotes B are bundled with the tape T; a heater 95 for joining the tape T in a state where the tape T is wound around the banknotes B; a cutter 96 that cuts the tape T at a position at which the tape T is not wound around the banknotes B; a printing unit 97 that performs printing on the tape T; and a stamping unit 98 that performs stamping on the tape T, as shown in FIG. 2.

Figure 3:
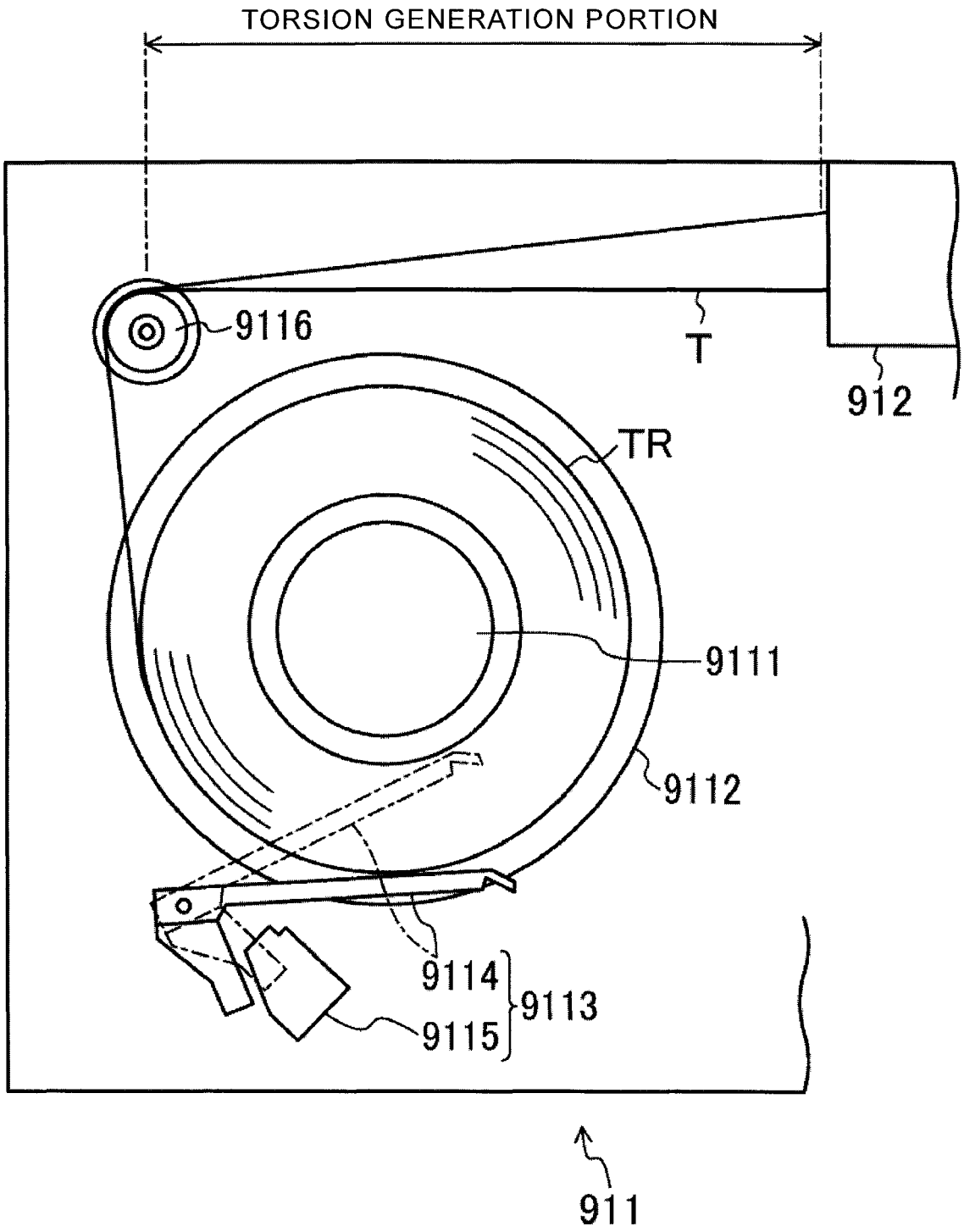
FIG. 3 is a plan view illustrating a structure of a tape setting unit.

The tape feeding unit 91 has: a tape setting unit 911 in which a tape roll TR having the tape T which is rolled, is set; and a tape transport unit 912 that transports the tape T drawn from the tape roll TR. The tape setting unit 911 includes: a reel 9111 around which the tape roll TR is mounted from the outside of the reel; and a reel base 9112 to which the reel 9111 is fixed, and which is rotatable, together with the reel 9111, around a rotation axis that extends in the up-down direction, as shown in FIG. 3. The reel 9111 and the reel base 9112 correspond to a reel unit. The reel base 9112 is driven to rotate by a tape reel motor 9117 (see FIG. 5) that includes a stepping motor, and is rotatable in each of a direction in which the tape T is fed and a direction in which the tape T is wound. The tape roll TR placed on the reel base 9112 rotates together with the reel base 9112, to feed the tape T or wind the tape T. The tape setting unit 911 includes a near-empty sensor 9113 that detects that the tape T of the tape roll TR set in the reel base 9112 is used up before long. The near-empty sensor 9113 includes a detection lever 9114 and a limit switch 9115. The detection lever 9114 is prompted so as to contact with the outer circumferential surface of the tape roll TR, and thus rotates around the axis that extends in the up-down direction, according to a tape amount of the tape roll TR (that is, the outer diameter of the tape roll TR). The limit switch 9115 detects that the detection lever 9114 has rotated up to a predetermined position at which the tape T may be used up, as indicated by an alternate long and short dash line in FIG. 3.

The tape T drawn from the tape roll TR is wound on a change roller 9116, and then transported to the tape transport unit 912. The change roller 9116 forms a part of the transport path provided between the reel unit and the tape loop forming unit 92 described below. Therefore, the change roller 9116 also forms a part of the tape transport unit 912. In the banknote handling apparatus 100, due to the layout of the inside thereof, the rotation center axis of the tape roll TR extends in the up-down direction in the tape setting unit 911, whereas the tape loop L is formed around the axis that extends in the horizontal direction in the tape loop forming unit 92 (corresponding to tape bundling unit) that forms the tape loop L with the tape T drawn therefrom, which will be described below in detail. Therefore, the tape T is twisted almost 90° while the tape T is transported to the tape transport unit 912 after the tape T is wound on the change roller 9116 (see "torsion generation portion" in FIG. 3).

As shown in FIG. 2, the tape setting unit 911 is disposed inside the housing 12 at the upper portion of the housing 12, and the tape setting unit 911 is opened upward when an opening and closing lid 121 provided in the housing 12 is opened. Thus, the tape roll TR can be set in the tape setting unit 911, or the tape roll TR of the tape setting unit 911 can be replaced.

When a new tape roll TR is set on the tape setting unit 911, the opening and closing lid 121 is opened, and the new tape roll TR is then set on the reel base 9112. Thereafter, an operator draws the tape T from the tape roll TR and winds the tape T on the change roller 9116, and then inserts the leading end of the tape T into the tape transport unit 912. In this state, the opening and closing lid 121 is closed. The tape transport unit 912 then transports the tape T toward the tape loop forming unit 92 until the first tape sensor 9210 detects the leading end of the tape T, and the tape reel motor 9117 of the tape setting unit 911 thereafter rotates the tape roll TR in the direction in which the tape T is wound, thereby removing slack in a mid-portion of the tape T. Thus, while the leading end of the tape T is positioned at a predetermined stand-by position near the tape loop forming unit 92, the tape T can be in a stand-by state in which the tape T is arranged continuously along the predetermined transport path between the reel unit and the tape loop forming unit 92, and tensile force is applied to the tape T. In the banknote handling apparatus 100, the tape T is basically in the stand-by state in a time period in which bundling of banknotes is not performed (also including a time period in which the power supply of the banknote handling apparatus 100 is switched off by an operation unit power switch 1002 described below being powered off).

The tape transport unit 912 transports the tape T along a predetermined transport path. Illustration of the specific structure of the tape transport unit 912 is omitted. The tape transport unit 912 has a plurality of roller pairs (including a pair of feed rollers 920 described below) and a guide (not shown) provided so as to nip the tape T in the thickness direction. By these roller pairs rotating in the forward direction and the reverse direction, the tape T can be fed toward the tape loop forming unit 92 and the tape T can be drawn back to the tape setting unit 911. A transport motor that drives the roller pairs of the tape transport unit 912 is independent of the tape reel motor 9117 that drives the reel base 9112 in the tape setting unit 911 described above, and the tape transport unit 912 and the tape setting unit 911 performs driving independently of each other.

The tape loop forming unit 92 forms the tape loop L by using the tape T, draws back the tape T after the stacked banknotes B have been positioned in the tape loop L, and winds the tape T around the banknotes B. The tape loop forming unit 92 includes: the paired feed rollers 920 that feed and draw back the tape T; a tape holding unit 921 that holds the leading end portion of the tape T; a guide unit 925 that defines the shape of the tape loop L when the tape loop L is formed by using the tape T; the first tape sensor 9210 that detects the leading end of the tape T; and the second tape sensor 9211 that detects that a large tape loop L2 has been formed, as shown in FIGS. 8 to 11. In the tape loop forming unit 92, the tape holding unit 921 forms a small tape loop L1 by using the tape T, and the small tape loop L1 is thereafter enlarged by the tape T being fed by the paired feed rollers 920, to form the large tape loop L2. At this time, the guide unit 925 guides the tape T and defines the shape of the large tape loop L2, and the second tape sensor 9211 detects that the large tape loop L2 has been formed.

The paired feed rollers 920 are driven by a tape feed motor 9212 (see FIG. 5) that includes a stepping motor, and feeds the tape T when the tape loop L is formed, and also draws back the tape T so as to wind the tape T around the banknotes B after the banknotes B have been positioned in the tape loop L. The paired feed rollers 920 are disposed at a downstream end portion of the tape transport unit 912, and also form a part of the tape transport unit 912. The paired feed rollers 920 represent an example of a feeding unit. The roller pairs of the tape transport unit 912 are also driven via a belt, a gear, or the like by the motor for the paired feed rollers 920.

The first tape sensor 9210 is provided in the transport path for the tape T between the paired feed rollers 920 and the tape holding unit 921. The first tape sensor 9210 has a structure similar to that of the banknote sensor 25. The first tape sensor 9210 detects the tape T by light being blocked. For example, in the first tape sensor 9210, when the paired feed rollers 920 draw back the tape T, and a state where light is blocked shifts to a state where light is received, the leading end of the tape T can be detected. A position at which the first tape sensor 9210 is disposed corresponds to a predetermined stand-by position at which the leading end of the tape T in the stand-by state is positioned.

The tape holding unit 921 is disposed at a position at which the tape T fed from the paired feed rollers 920 can be received. The tape holding unit 921 is structured so as to be able to hold the tape T and be rotatable while holding the tape T. The tape holding unit 921 rotates while holding the leading end portion of the tape T fed from paired feed rollers 920, thereby forming the tape loop L.

Figure 4:
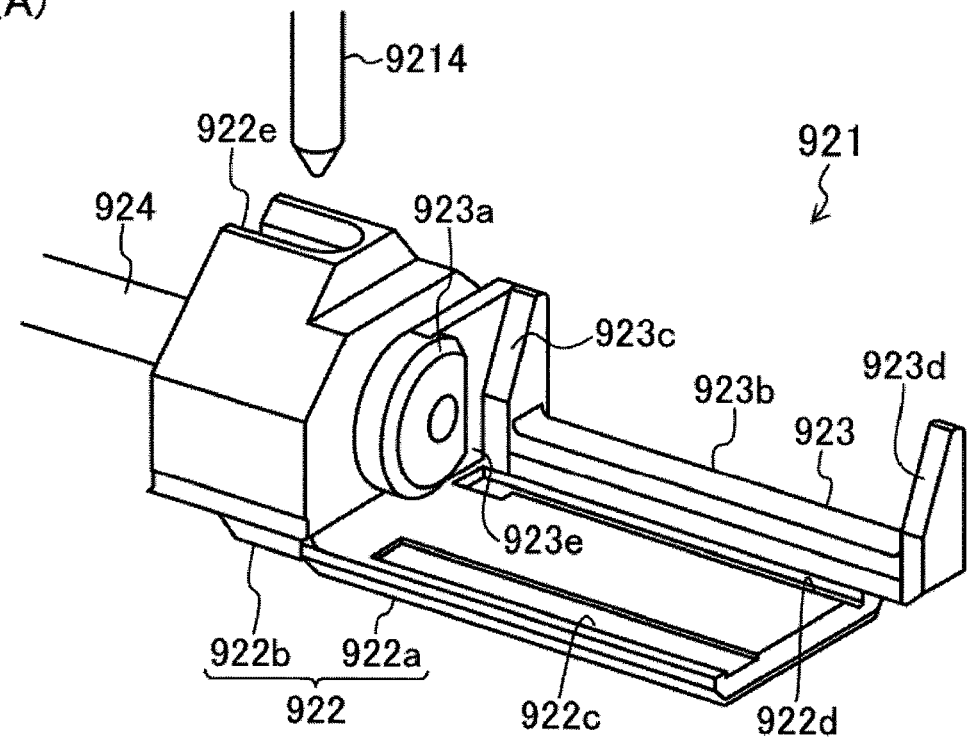
FIG. 4 is a perspective view of a tape holding unit, and (A) thereof shows a closed state of the tape holding unit, and (B) thereof shows an open state of the tape holding unit.
Figure 4:
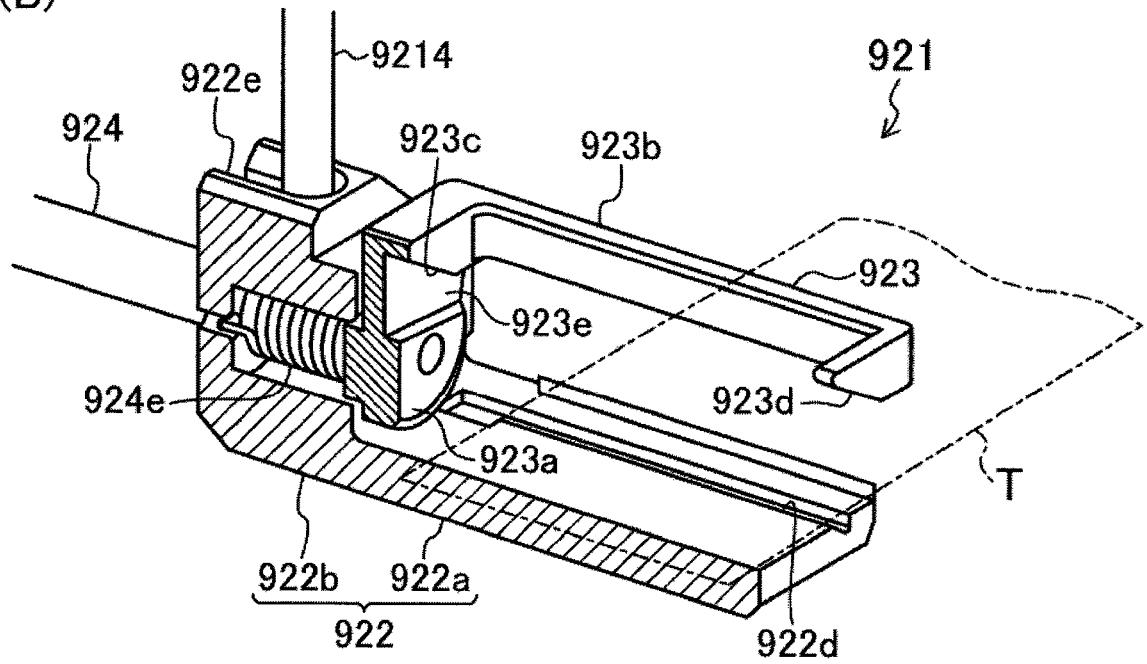

FIG. 4 is a perspective view of the tape holding unit 921. (A) of FIG. 4 shows a closed state of the tape holding unit 921 and (B) of FIG. 4 shows an open state of the tape holding unit 921. (B) of FIG. 4 illustrates the tape holding unit 921, a part of which is cut.

The tape holding unit 921 has a base portion 922, a movable portion 923, and a rotation shaft 924. The base portion 922 has a flat-plate-like base plate 922*a* and a base block 922*b* integrated with the base plate 922*a*. The base plate 922*a* has a first and a second recessed grooves 922*c*, 922*d* that extend parallel to each other. The first and the second recessed grooves 922*c*, 922*d* extend in the tape width direction. The rotation shaft 924 is inserted into the base block 922*b* so as to be rotatable. Thus, the base portion 922 is supported by the rotation shaft 924 so as to be rotatable, independently of the rotation shaft 924, around the rotation shaft 924 as the center axis. The base block 922*b* also has an engagement portion 922*e* into which a lock pin 9214 described below is inserted, and the engagement portion 922*e* is opened upward.

The rotation shaft 924 extends in the tape width direction, and the rotation shaft 924 is driven to rotate by a not-illustrated stepping motor. The movable portion 923 is disposed so as to oppose the base plate 922*a*, and is fixed to the end of the rotation shaft 924 such that the movable portion 923 cannot rotate relative to the rotation shaft 924. The movable portion 923 is driven to rotate via the rotation shaft 924. The movable portion 923 has: a mounting portion 923*a* mounted at the end of the rotation shaft 924; and a pressing portion 923*b* that is mounted in the mounting portion 923*a* so as to be eccentric with respect to the rotation shaft 924 and that extends parallel to the rotation shaft 924 (that is, in the tape width direction); and a first and a second guide portions 923*c*, 923*d* provided at both ends of the pressing portion 923*b*. The first guide portion 923*c* forms a guide groove 923*e* between the first guide portion 923*c* and the mounting portion 923*a*.

When the rotation shaft 924 rotates around the axis thereof in one side direction, the movable portion 923 overlaps the base plate 922*a* as shown in (A) of FIG. 4. This state is referred to as a closed state of the tape holding unit 921. Meanwhile, when the rotation shaft 924 rotates around the axis thereof in the other side direction, the movable portion 923 enters a state where a gap is formed between the movable portion 923 and the base plate 922*a* as shown in (B) of FIG. 4. This state is referred to as an open state of the tape holding unit 921. When the tape holding unit 921 is in the open state, the tape T can be inserted between the movable portion 923 and the base plate 922*a* as imaginarily indicated in (B) of FIG. 4. Thereafter, when the tape holding unit 921 enters the closed state, the tape T is held between the movable portion 923 and the base plate 922*a*.

As shown in (B) of FIG. 4, a torsion coil spring 924*e* is mounted around the rotation shaft 924 from the outside thereof. The torsion coil spring 924*e* is mounted inside the base block 922*b* of the base portion 922. One end portion of the torsion coil spring 924*e* engages with the base portion 922. The other end portion of the torsion coil spring 924*e* engages with the mounting portion 923*a* of the movable portion 923, which is not shown in (B) of FIG. 4. The torsion coil spring 924*e* prompts the base portion 922 and the movable portion 923 so as to rotate relative to each other such that the tape holding unit 921 is in the closed state. The movable portion 923 and the base plate 922*a* are maintained so as to overlap each other by rotation prompting force of the torsion coil spring 924*e*.

Figure 14:
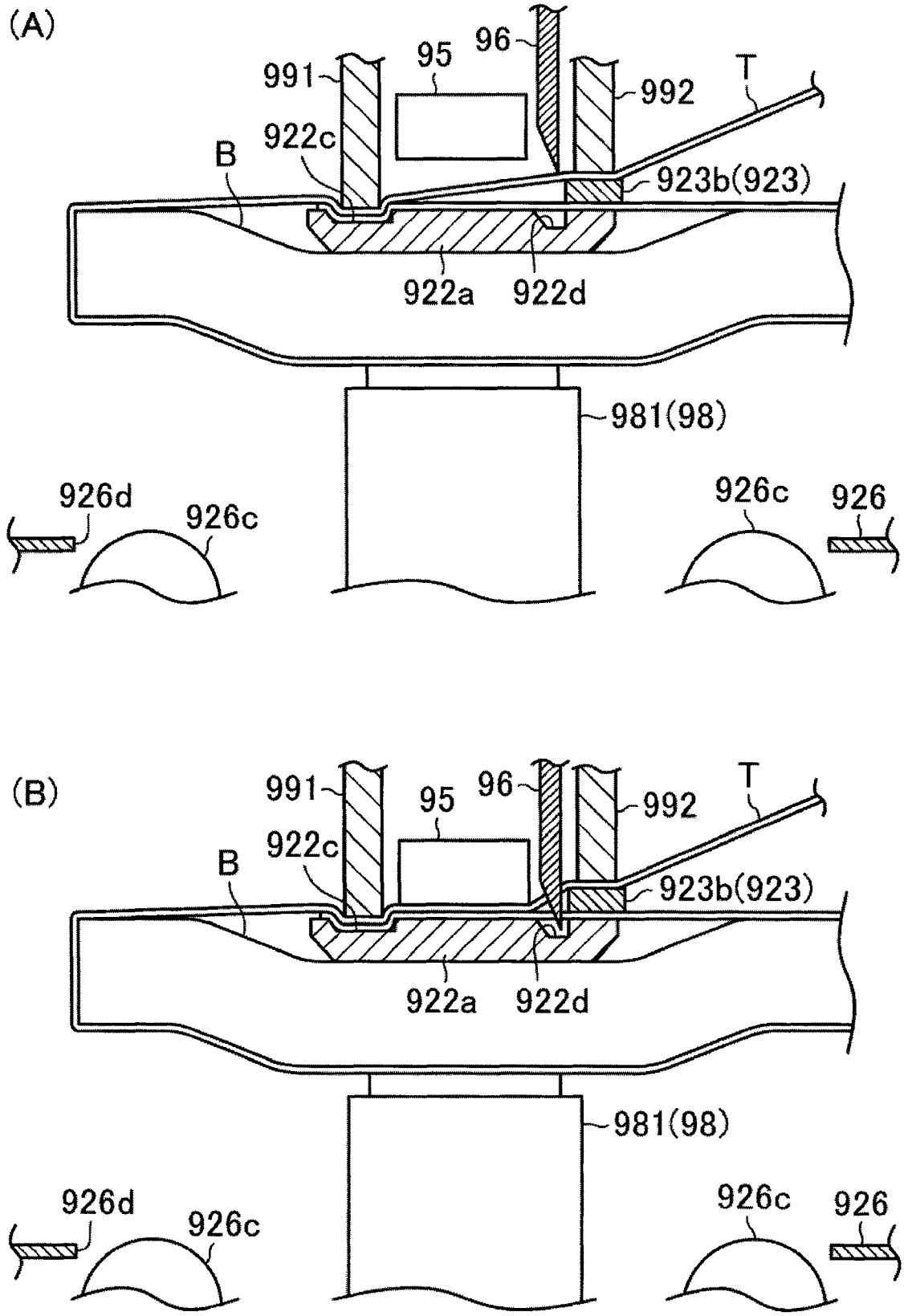
FIG. 14 illustrates joining of the tape, cutting thereof, and stamping thereon, and (A) thereof illustrates a state where the tape is pressed by a first and a second tape pressing portions, and (B) thereof illustrates a state where the tape is melt-adhered by a heater and the tape is cut by a cutter.

In the closed state of the tape holding unit 921, the pressing portion 923*b* of the movable portion 923 overlaps a portion, of the base plate 922*a*, adjacent to the second recessed groove 922*d* (also see FIG. 14). That is, the second recessed groove 922*d* is exposed at a position adjacent to the pressing portion 923*b*. At this time, the first and the second guide portions 923*c*, 923*d* extend in the direction orthogonal to the base plate 922*a*. Similarly, the guide groove 923*e* also extends in the direction orthogonal to the base plate 922*a*.

The lock pin 9214 is disposed vertically above the base block 922*b* so as to be able to reciprocate in the up-down direction. The lock pin 9214 advances into and retracts from the engagement portion 922*e* of the base portion 922. The lock pin 9214 is a round-bar-like member that extends in the up-down direction, and the lower end portion thereof is tapered. The lower end portion of the lock pin 9214 advances into the engagement portion 922*e* provided in the base block 922*b* as described below, and the lower end portion thereof is tapered, whereby the lock pin 9214 easily advances into the engagement portion 922*e*.

As shown in (B) of FIG. 4, when the lock pin 9214 is moved downward, the tapered lower end portion advances into the engagement portion 922*e* provided in the base block 922*b*. This state is a locked state in which the base portion 922 is prevented from rotating. When the stepping motor performs driving in one side direction, as described above, in the locked state, only the movable portion 923 rotates according to rotation of the rotation shaft 924. As a result, the tape holding unit 921 enters the open state. Meanwhile, a state where, as shown in (A) of FIG. 4, the lock pin 9214 is moved upward, and the lower end portion of the lock pin 9214 retracts from the engagement portion 922*e*, is an unlocked state in which the base portion 922 is allowed to rotate. When the stepping motor performs driving in the one side direction in the unlocked state, the base portion 922 and the movable portion 923 integrally rotate, according to rotation of the rotation shaft 924, by rotation prompting force of the torsion coil spring 924*e*. As a result, when the tape T is inserted in the open state, the tape holding unit 921 rotates around the rotation shaft 924 in a state where the tape T is held by the base plate 922*a* and the movable portion 923.

FIGS. 8 to 11 are each a front view of the guide unit 925. When the large tape loop L2 is formed, the guide unit 925 contacts with the outer circumferential surface of the large tape loop L2, and defines the shape of the large tape loop L2. The guide unit 925 defines the large tape loop L2 so as to have an almost rectangular shape, specifically, a rectangular shape in which corner portions are curved.

The guide unit 925 has: a lower guide portion 926 that contacts with the outer circumferential surface of the large tape loop L2 from below the large tape loop L2; a first side guide portion 927 and a second side guide portion 928 that contact with the outer circumferential surface of the large tape loop L2 in the horizontal direction; and four corner guide portions, that is, a first to a fourth corner guide portions 929*a* to 929*d*, corresponding to four corner portions of the rectangular shape.

For the lower guide portion 926, a plurality of rollers 926*c*, 926*c*, . . . for improving slidability of the tape T are provided, as shown in FIG. 14 in an enlarged manner. The lower guide portion 926 has a through hole 926*d* through which a stamp 981 of the stamping unit 98 described below, passes.

The first corner guide portion 929*a* and the second corner guide portion 929*b* are provided on both end portions, of the lower guide portion 926, in the longitudinal direction. The tape T positioned at the corner portion formed by the lower guide portion 926 and the first side guide portion 927 is curved by the first corner guide portion 929*a*. The tape T positioned at the corner portion formed by the lower guide portion 926 and the second side guide portion 928 is curved by the second corner guide portion 929*b*.

Figure 13:
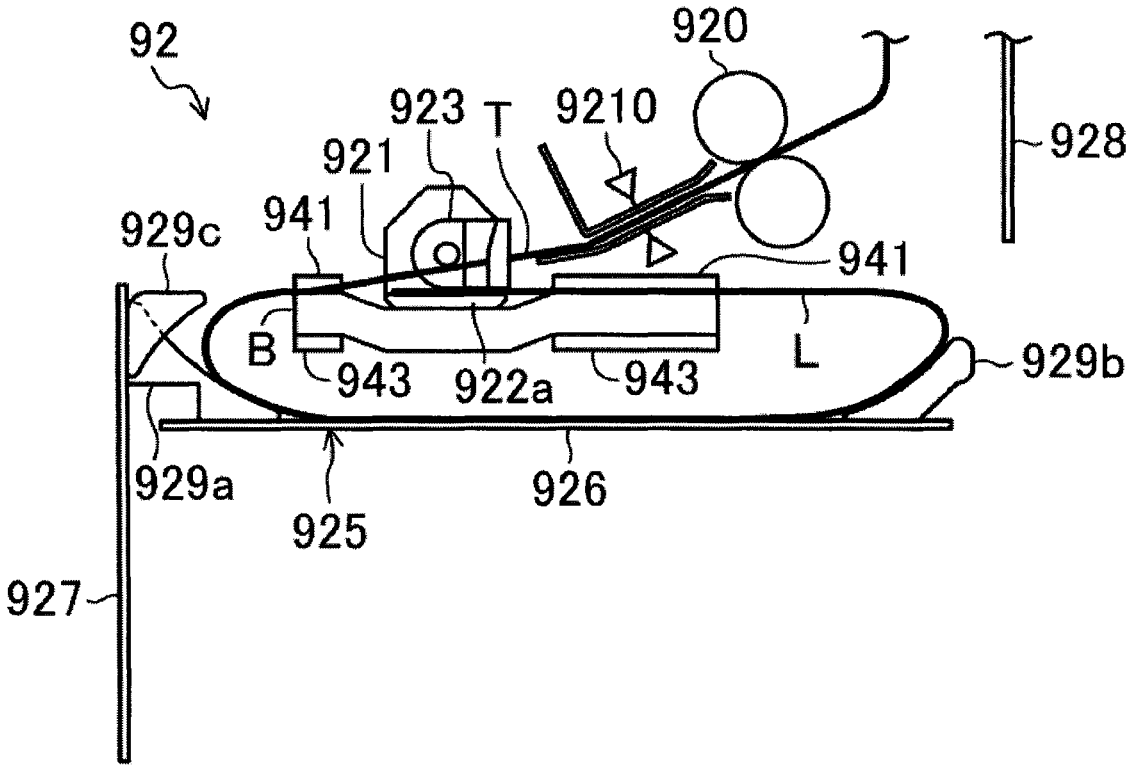
FIG. 13 illustrates a guide unit in a state where banknotes are pressed by a clamping unit.

A movement mechanism is provided for the lower guide portion 926, and the lower guide portion 926 is movable upward and downward by the movement mechanism (see FIG. 13). The movement mechanism is common between the lower guide portion 926 and lower clamp portions 943, 944 described below.

The first side guide portion 927 extends in the up-down direction at the end portion, on the bundling stacker 4 side, in the longitudinal direction of the lower guide portion 926.

The second side guide portion 928 extends in the up-down direction at the end portion, on the outlet portion 11 side, in the longitudinal direction of the lower guide portion 926. The second side guide portion 928 is supported by a support unit so as to be movable upward and downward, and connected to the lower guide portion 926 via a link. Thus, the second side guide portion 928 moves upward in conjunction with the upward movement of the lower guide portion 926, and moves downward in conjunction with the downward movement of the lower guide portion 926. A distance over which the second side guide portion 928 moves is amplified by the link. The second side guide portion 928 is configured to retract upward so as not to prevent transporting of the bundled banknotes B when the bundled banknotes B are transported.

The third corner guide portion 929*c* and the fourth corner guide portion 929*d* are provided above the first corner guide portion 929*a* and the second corner guide portion 929*b*, respectively, so as to be almost level with the tape holding unit 921. The third corner guide portion 929*c* is provided adjacent to the first side guide portion 927. The fourth corner guide portion 929*d* is provided adjacent to the second side guide portion 928.

Figure 8:
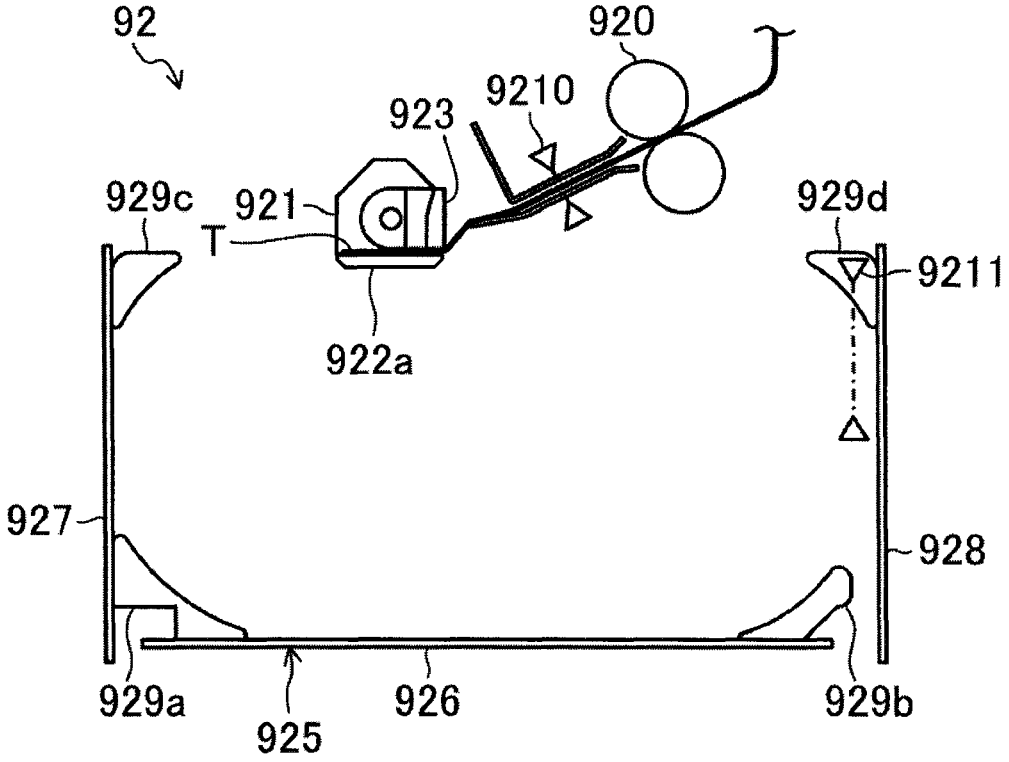
FIG. 8 illustrates a state where the tape holding unit holds a leading end portion of the tape.

The second tape sensor 9211 has a structure similar to that of the banknote sensor 25, and detects the tape T by light being blocked. The receiver unit of the second tape sensor 9211 is attached to the fourth corner guide portion 929*d* as shown in FIG. 8 and the like. The transmitter unit of the second tape sensor 9211 is positioned such that light from the transmitter unit is blocked by the tape T guided to the fourth corner guide portion 929*d*. That is, when the transmitter unit emits light and the receiver unit does not receive the light, the second tape sensor 9211 detects that the tape T is guided by the fourth corner guide portion 929*d*, that is, that the tape loop L has a predetermined size.

When the banknotes B are bundled by the tape T, the clamp unit 94 presses the banknotes B in the stacking direction. The clamp unit 94 presses a portion, of the banknotes B, near a portion that is to be bundled by the tape T. The clamp unit 94 has: a pair of upper clamp portions 941 (only one of the paired upper clamp portions is shown in FIG. 6 or the like) provided above the banknotes B that has been transported into the tape loop L; and a pair of lower clamp portions 943, 944 (see FIG. 12) provided below the banknotes B.

The lower clamp portions 943, 944 are integrated with the lower guide portion 926 of the guide unit 925. That is, the lower clamp portions 943, 944 and the lower guide portion 926 integrally move upward and downward.

The heater 95 allows the tape T to be joined in a state where the tape T is wound around the banknotes B. The tape T has an adhesive layer on the back surface side, which is not shown in detail, and the heater 95 heats the tape T, to melt the adhesive layer, whereby the tape T is melt-adhered. The heater 95 represents an example of a joining unit.

The cutter 96 cuts a portion, of the tape T, which is not wound around the banknotes B, that is, a remaining portion of the tape T that has bundled the banknotes B. The end of the cutter 96 has a saw-teeth-like cutting blade.

The heater 95 and the cutter 96 are formed into a unit, and are disposed on a side opposite to the stamping unit 98 side with respect to the banknotes B disposed in the tape loop L, specifically, on a side opposite to the stamping unit 98 side in the direction in which the banknotes B are stacked. More specifically, the heater 95 and the cutter 96 are disposed above the tape holding unit 921. The heater 95 allows the tape T to be joined on the base plate 922*a* of the tape holding unit 921. The cutter 96 cuts the tape T on the base plate 922*a* of the tape holding unit 921.

The printing unit 97 is provided in the tape transport unit 912 as shown in FIG. 2. The printing unit 97 performs printing on the surface of the tape T transported by the tape transport unit 912. For example, the printing unit 97 prints, on the tape T, information (for example, denomination, date and time, serial number, and the like) associated with the banknotes B to be bundled. Contents to be printed on the tape by the printing unit 97 will be described below in detail. A position on which the printing unit 97 performs printing, is displaced in the tape width direction relative to a portion that is to be stamped by the stamping unit 98 such that a portion for the printing by the printing unit 97 does not overlap a portion for stamping by the stamping unit 98.

The stamping unit 98 performs stamping on the tape T in a state where the banknotes B are pressed by the clamp unit 94 and the tape T is wound around the banknotes B. The stamping unit 98 stamps the surface of the tape T with, for example, a seal (for example, a seal of a financial facility, or a seal representing a kind of a banknote such as a fit note or an unfit note) associated with the banknotes B to be bundled. The stamping unit 98 is disposed on a side opposite to the heater 95 and the cutter 96 sides with respect to the banknotes B disposed in the tape loop L, specifically, disposed on a side opposite to the heater 95 and the cutter 96 sides in the direction in which the banknotes B are stacked, as shown in FIG. 14. The stamping unit 98 includes the stamp 981, and a movement mechanism for moving the stamp 981 in the up-down direction.

<System Configuration of Banknote Handling Apparatus>

Figure 5:
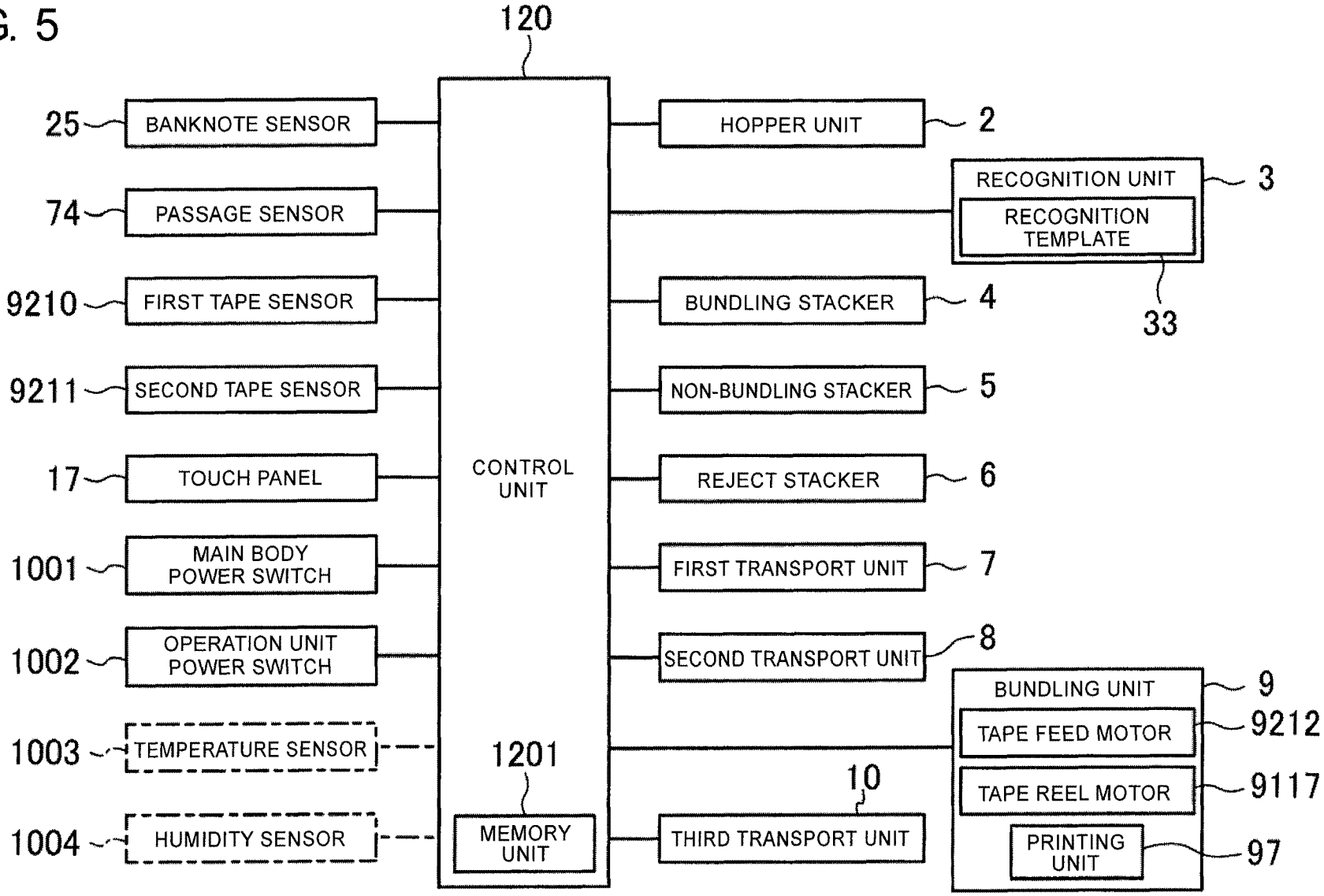
FIG. 5 is a block diagram illustrating a schematic configuration of the banknote handling apparatus.

FIG. 5 is a block diagram illustrating a schematic configuration of the banknote handling apparatus 100.

The banknote handling apparatus 100 includes the control unit 120 based on, for example, a well-known microcomputer. The control unit 120 has a memory unit 1201 in which various information is stored. To the control unit 120, the hopper unit 2, the recognition unit 3, the bundling stacker 4, the non-bundling stacker 5, the reject stacker 6, the first transport unit 7, the second transport unit 8, the bundling unit 9, the third transport unit 10, and the touch panel 17, which are described above, are connected such that signals can be transmitted and received. To the control unit 120, the banknote sensor 25, the passage sensors 74, the first tape sensor 9210, and the second tape sensor 9211 are connected, and the detection signals therefrom are inputted to the control unit 120. The control unit 120 generates a control signal based on, for example, an input signal from the touch panel 17 and detection signals from the various sensors, and outputs the control signal to the hopper unit 2 and the like. The hopper unit 2 and the like operate according to the control signal.

The banknote handling apparatus 100 includes: a main body power switch (that is, main power supply) 1001 for supplying power necessary for the apparatus 100; and the operation unit power switch (that is, auxiliary power supply) 1002 for operating the functions of the apparatus 100. The main body power switch 1001 usually remains on, and the operation unit power switch 1002 is switched on when the banknote handling apparatus 100 is used, and the operation unit power switch 1002 is switched off when the banknote handling apparatus 100 is not used.

<Description for Operation of Banknote Handling Apparatus>

Hereinafter, depositing performed by the banknote handling apparatus 100 will be described. In depositing, loose banknotes are sorted and stacked in predetermined stackers, and, further, predetermined banknotes are bundled. Hereinafter, a same-kind-banknote bundling in which banknotes, of one predetermined kind, to be bundled are stacked by a predetermined number alternately in the first and the second bundling stackers 4A, 4B and the predetermined number of stacked banknotes are sequentially bundled by the bundling unit 9, will be described.

Firstly, an operator receives, from a customer, loose banknotes to be deposited, and places the banknotes in the hopper unit 2. At this time, even if the loose banknotes include a plurality of kinds of banknotes, the loose banknotes are placed in the hopper unit 2 without sorting the loose banknotes. The operator adjusts the guide portions 22 so as to correspond to the dimensions of the banknotes. Subsequently, the operator operates the touch panel 17 and starts taking-in of the banknotes. When the banknote sensor 25 detects that the banknotes are placed in the hopper unit 2, the banknote handling apparatus 100 may automatically start taking-in of the banknotes.

The banknotes placed in the hopper unit 2 are taken one by one into the housing 12 through the inlet 24 by actuation of the taking-in roller 23. The banknotes having been taken in are transported by the first transport unit 7, and pass through the recognition unit 3. The recognition unit 3 recognizes a kind of the passing banknote and notifies the control unit 120 of the kind of the banknote.

The control unit 120 determines, according to the kind of the banknote, a corresponding destination to which the banknote is to be transported. Specifically, when the banknote is a fit banknote, of a predetermined denomination, to be bundled, the control unit 120 determines the bundling stacker 4 (one of 4A or 4B) as the destination. When the banknote is an unfit banknote of the predetermined denomination of a banknote to be bundled, the control unit 120 determines the first non-bundling stacker 5A as the destination. When the banknote is a banknote of a denomination other than the predetermined denomination, the control unit 120 determines the second non-bundling stacker 5B as the destination. When the banknote is a rejected note, the control unit 120 determines the reject stacker 6 as the destination.

The banknotes to be transported to the bundling stacker 4 are transported to one of the two bundling stackers 4. When the number of banknotes stacked in one of the bundling stackers 4 reaches a predetermined number of banknotes to be bundled (for example, 100 banknotes), the subsequent banknotes are transported to the other of the bundling stackers 4. In the description herein, the banknotes are firstly transported to the first bundling stacker 4A.

When the number of banknotes stacked in the first bundling stacker 4A reaches the number of banknotes to be bundled, the control unit 120 controls the second transport unit 8 such that the banknotes in the first bundling stacker 4A are held by the holding unit 81, and the banknotes are transported to the bundling unit 9. Thereafter, the control unit 120 controls the bundling unit 9 so as to bundle the banknotes with the tape T.

When the number of banknotes stacked in the first bundling stacker 4A reaches the number of banknotes to be bundled, the subsequent banknotes are stacked in the second bundling stacker 4B. Thereafter, when the number of the banknotes stacked in the second bundling stacker 4B reaches the number of banknotes to be bundled, the subsequent banknotes are stacked again in the first bundling stacker 4A. By that time, transporting of the banknotes in the first bundling stacker 4A has been completed, and the first bundling stacker 4A is empty. Thus, when the two bundling stackers 4 are provided, bundling can be performed while banknotes are continuously stacked.

Subsequently, the control unit 120 controls the third transport unit 10 so as to discharge the bundled banknotes through an outlet 111.

An unfit banknote of the predetermined denomination is transported into the first non-bundling stacker 5A. Thus, an unfit banknote of the predetermined denomination is stacked in the first non-bundling stacker 5A. Similarly, banknotes of denominations other than the predetermined denomination are transported into the second non-bundling stacker 5B, and stacked in the second non-bundling stacker 5B. Similarly, a rejected note is transported into the reject stacker 6 and stacked in the reject stacker 6.

The above-described handling is continuously performed until the banknotes placed in the hopper unit 2 have been all taken in. The banknote sensor 25 detects whether or not a banknote is in the hopper unit 2.

When the handling of the banknotes placed in the hopper unit 2 has been completed, taking-in and recognition of the rejected note are performed again. That is, the operator extracts the rejected note from the reject stacker 6 and places the rejected note in the hopper unit 2, and taking-in of the rejected note is performed again. The rejected note is a banknote which is not recognized as a normal banknote for some reason. Therefore, taking-in and recognition thereof are attempted again. The banknote recognized again as the rejected note is stacked in the reject stacker 6 again. The operator returns the banknote stacked again to the customer.

Taking-in of the banknotes stacked in the first and the second non-bundling stackers 5A, 5B is not performed again.

When the handling of banknotes placed in the hopper unit 2 and the re-handling of the rejected note have been completed, the same-kind-banknote bundling is completed, and counting and sorting of the banknotes that are delivered from the customer and are to be deposited are ended. On the touch panel 17, the counted monetary amount is displayed. The operator receives an approval of the monetary amount from the customer, or confirms that the monetary amount is equal to the monetary amount written by the customer on the deposit slip, and performs confirmation operation for the deposited monetary amount by using the touch panel 17. When the confirmation operation has been performed, a higher-ranking device (not shown) is notified of the confirmed deposited monetary amount, thereby completing the depositing.

After the depositing has been completed, the operator extracts the bundled banknotes discharged in the outlet portion 11, the banknotes stacked in the bundling stacker 4, and the banknotes stacked in the non-bundling stacker 5, and stores the banknotes in a predetermined storage place.

In the above-described handling, the loose banknotes including a plurality of kinds of banknotes are sorted into fit notes of the predetermined denomination, unfit notes of the predetermined denomination, banknotes of denominations other than the predetermined denomination, and rejected notes, and the fit notes of the predetermined denomination are bundled in units of the number of banknotes to be bundled.

<Detailed Description for Handling After Sstacking>

Hereinafter, handling, from a state of banknotes having been stacked in the bundling stacker 4, to discharging thereof into the outlet portion 11 will be described in detail.

—Transporting of Banknotes to Bundling Unit—

When stacking of the banknotes B has been completed, the second transport unit 8 transports the banknotes B from the bundling stacker 4 to the bundling unit 9. FIG. 6 illustrates a state where the banknotes B are extracted from the bundling stacker 4 by the second transport unit 8. FIG. 7 illustrates a state where the second transport unit 8 has transported the banknotes B to a lateral side of the tape loop L.

Specifically, when stacking of the banknotes B has been completed, the second transport unit 8 moves to the bundling stacker 4 at which the stacking of the banknotes B has been completed, holds the banknotes B in the bundling stacker 4, and extracts the banknotes from the bundling stacker 4 as shown in FIG. 6.

Subsequently, the second transport unit 8 moves the banknotes B to a predetermined second position in the up-down direction as shown in FIG. 7. The second position is a position at which the banknotes B are transported into the large tape loop L2. At the second position, the banknotes B are positioned near the center portion of the large tape loop L2 as viewed in the long edge direction of the banknotes B.

—Forming of Tape Loop—

Figure 9:
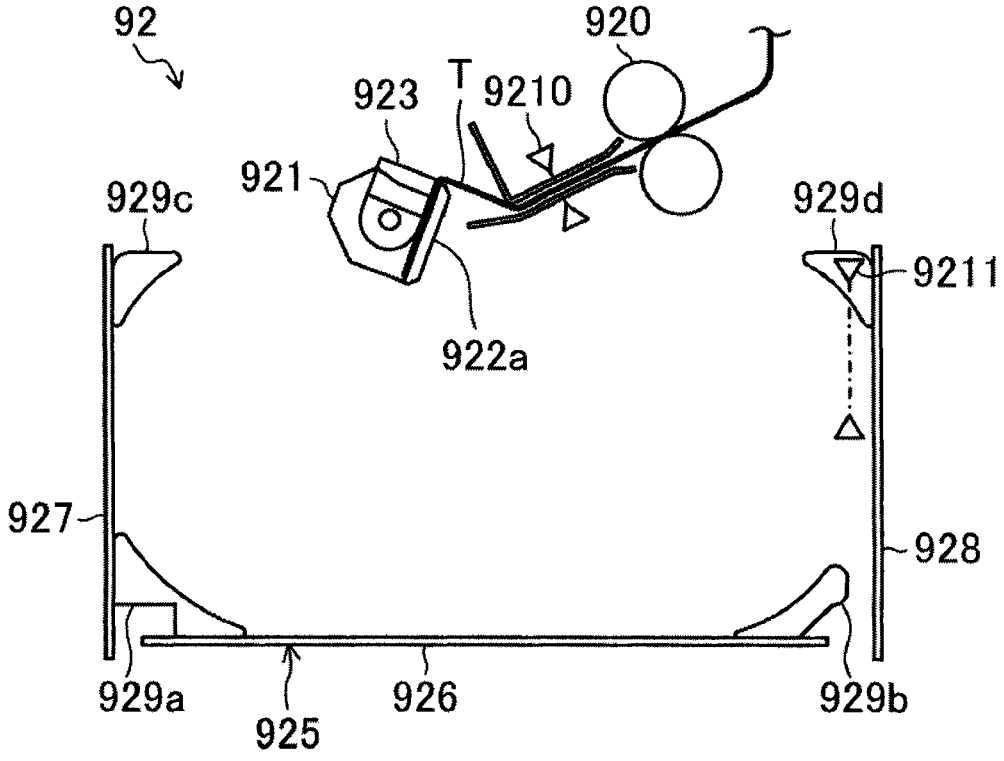
FIG. 9 illustrates a state where the tape holding unit starts rotating while holding the leading end portion of the tape.
Figure 10:
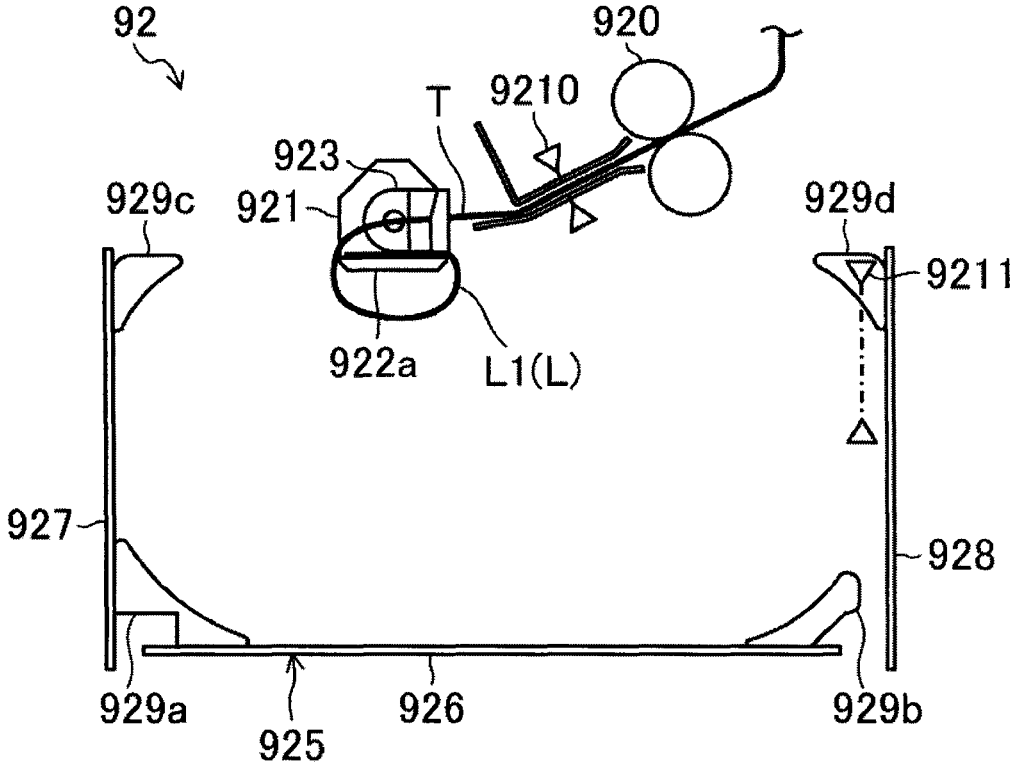
FIG. 10 illustrates a state where the tape holding unit has formed a small tape loop.
Figure 11:
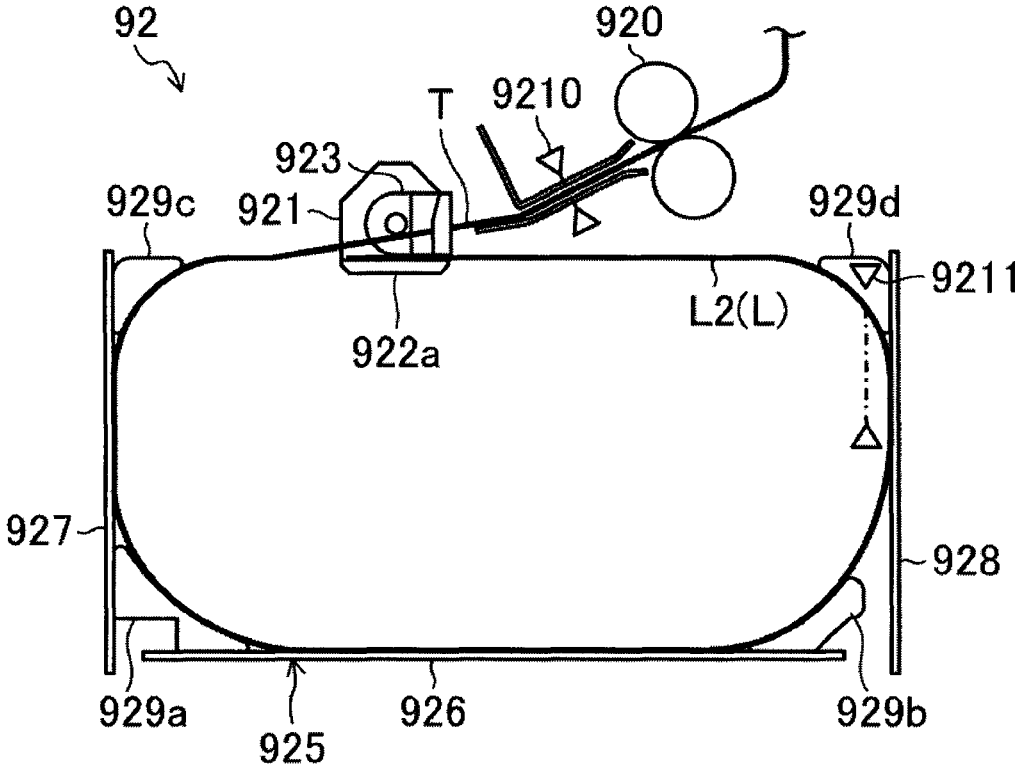
FIG. 11 illustrates a state where a large tape loop has been formed.

The control unit 120 operates so as to form the large tape loop L2 while the second transport unit 8 transports the banknotes B from the bundling stacker 4 to the second position. FIG. 8 illustrates a state where the tape holding unit 921 holds the leading end portion of the tape T. FIG. 9 illustrates a state where the tape holding unit 921 starts rotating while holding the leading end portion of the tape T. FIG. 10 illustrates a state where the tape holding unit 921 has formed the small tape loop L1. FIG. 11 illustrates a state where forming of the large tape loop L2 has been completed.

When bundling of banknotes is not performed, the tape T is in a stand-by state in which the tape T is arranged continuously along the transport path between the reel unit and the tape loop forming unit 92 such that the leading end of the tape T is disposed at a predetermined position near the first tape sensor 9210, and tensile force is applied to the tape T so as to generate no slack.

When forming of the tape loop L is started, the paired feed rollers 920 feed the tape T. At this time, the lock pin 9214 causes the base portion 922 to be in the locked state and the stepping motor for the tape holding unit 921 performs driving in the one side direction, whereby the tape holding unit 921 is oriented in a stand-by state in which a gap is formed between the movable portion 923 and the base plate 922*a*, and the tape T fed from the paired feed rollers 920 is inserted into the gap (also see (B) of FIG. 4).

The tape T is fed by the paired feed rollers 920 by an amount that allows the leading end portion of the tape T to be inserted between the movable portion 923 and the base plate 922*a*, and the stepping motor for the tape holding unit 921 performs driving in the other side direction. Thus, the rotation shaft 924 is driven to rotate, and the leading end portion of the tape T is held by the movable portion 923 and the base plate 922*a*, as shown in FIG. 8 (also see (A) of FIG. 4). Both the movable portion 923 and the base plate 922*a* hold the leading end portion of the tape T due to rotation prompting force of the torsion coil spring 924*e*. The leading end portion of the tape T is held by the tape holding unit 921 in a state where the leading end portion is almost horizontally oriented.

The printing unit 97 performs printing on the tape T in parallel with feeding of the tape T by the paired feed rollers 920.

Subsequently, the lock pin 9214 causes the base portion 922 to be in the unlocked state, and the stepping motor for the tape holding unit 921 performs driving in the one side direction, whereby the tape holding unit 921 starts rotating in a state where the leading end portion of the tape T is held due to rotation prompting force of the torsion coil spring 924*e*, as shown in FIG. 9. At this time, the tape T continues to be fed by the paired feed rollers 920. The tape holding unit 921 rotates so as to move the leading end of the tape T downward, that is, rotates counterclockwise in FIG. 9.

When the tape holding unit 921 has performed almost one rotation, the tape loop L is formed as shown in FIG. 10. The tape loop L which is thus formed by the tape holding unit 921 performing almost one rotation is referred to as "small tape loop L1". The leading end portion of the tape T held by the tape holding unit 921 is positioned at the upper portion of the small tape loop L1, and the small tape loop L1 is formed below the tape holding unit 921. Further, the small tape loop L1 is formed at a position lower than the paired feed rollers 920.

When the small tape loop L1 has been formed, the tape holding unit 921 stops rotating, and the tape T continues to be fed by the paired feed rollers 920. As a result, the small tape loop L1 is gradually enlarged. The leading end portion of the tape T held by the tape holding unit 921 is positioned at the upper portion of the small tape loop L1, and the tape T is fed by the paired feed rollers 920 from the upper portion of the small tape loop L1, whereby the small tape loop L1 is expanded downward. Below the tape holding unit 921, the guide unit 925 is disposed, whereby the tape loop L contacts with the guide unit 925 in due course, and the shape of the tape loop L is defined by the guide unit 925. When an amount of the tape T that has been fed from the paired feed rollers 920 finally reaches a predetermined amount, the tape loop L is formed so as to have an almost rectangular shape by the guide unit 925, as shown in FIG. 11. The tape loop L is referred to as a "large tape loop L2". The large tape loop L2 contacts with the lower guide portion 926, the first side guide portion 927, and the second side guide portion 928, and is formed into an almost rectangular shape. In addition thereto, the large tape loop L2 contacts with the first to the fourth corner guide portions 929*a* to 929*d*, whereby the large tape loop L2 is formed into a rectangular shape in which the corner portions are curved.

When an amount of the tape T that has been fed from the paired feed rollers 920 has become the predetermined amount, the control unit 120 detects that the large tape loop L2 has been formed according to the second tape sensor 9211 detecting the tape T.

The second tape sensor 9211 is configured to detect the tape T guided to the fourth corner guide portion 929*d*. That is, when the banknotes B are transported into the large tape loop L2, the second tape sensor 9211 detects whether or not the tape T is at a predetermined position above the banknotes B. If a part of the tape loop L bends inward, the upper portion of the tape loop L is likely to bend due to the weight of the tape T itself. That is, the second tape sensor 9211 is disposed at the above-described position, whereby bending of the tape loop L can be accurately detected.

The large tape loop L2 is formed, as shown in FIGS. 6, 7, in parallel with an operation, by the second transport unit 8, of transporting the banknotes B from the bundling stacker 4 to the bundling unit 9. In general (that is, in a case where the large tape loop L2 is formed by feeding of the tape T being performed once), when the banknotes B have been transported to the second position, forming of the large tape loop L2 has been completed.

—Winding of Tape—

Figure 12:
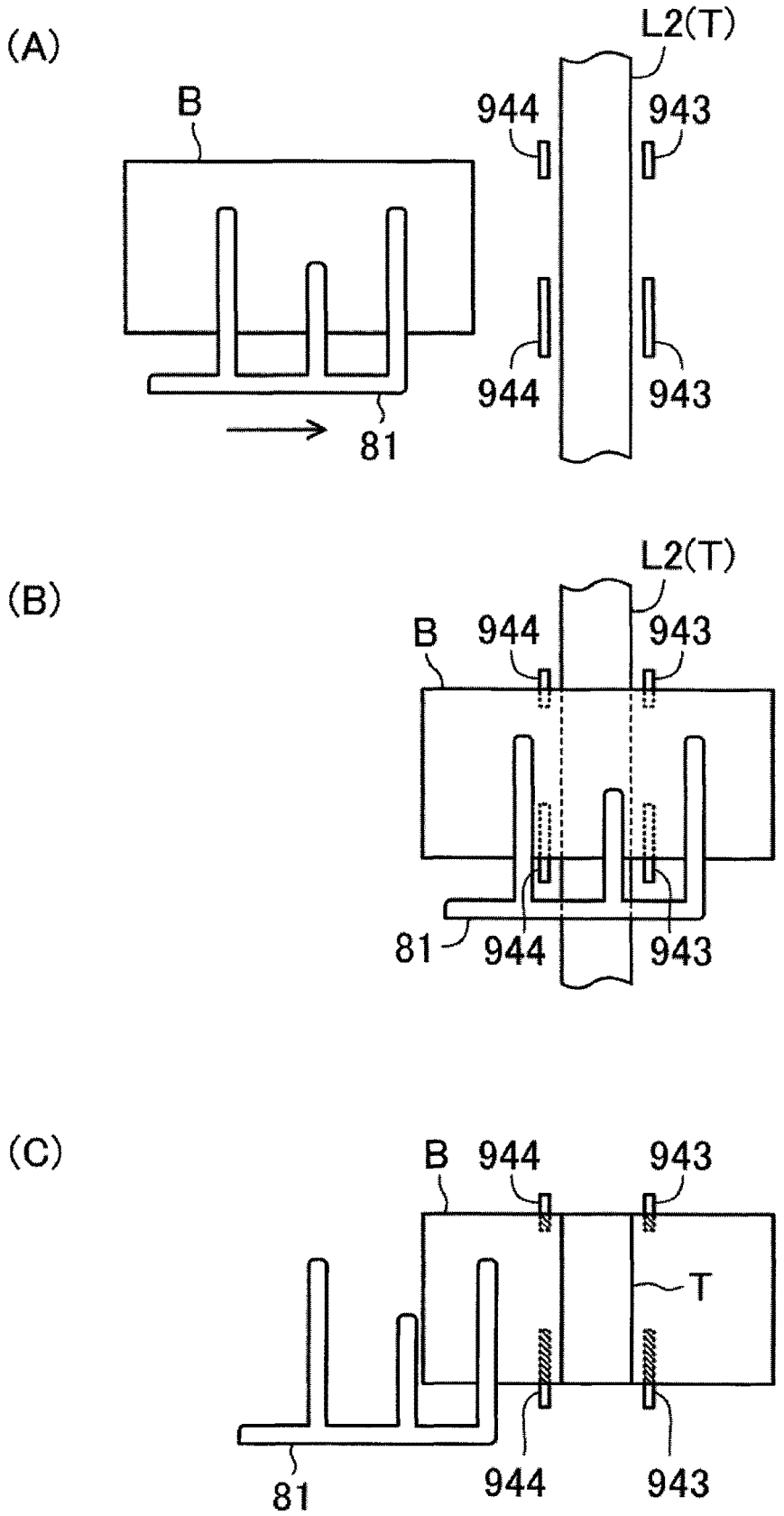
FIG. 12 illustrates an operation, performed by each component, from transporting of banknotes into the large tape loop, to winding of the tape around the banknotes, as viewed in the thickness direction of the banknotes, and (A) thereof illustrates a state immediately before the banknotes are transported into the large tape loop, and (B) thereof illustrates a state where the banknotes have been transported into the large tape loop, and (C) thereof illustrates a state where the tape has been wound around the banknotes.

FIG. 12 illustrates an operation, performed by each component, from transporting of the banknotes B into the large tape loop L2 to winding of the tape T around the banknotes B, as viewed in the thickness direction of the banknotes B. In FIG. 12, (A) thereof illustrates a state immediately before the banknotes B are transported into the large tape loop L2, (B) thereof illustrates a state where the banknotes B have been transported into the large tape loop L2, and (C) thereof illustrates a state where the tape T has been wound around the banknotes B. FIG. 13 illustrates the guide unit 925 in a state where the banknotes B are pressed by the clamping unit 94. In FIG. 12, the upper clamp portions 941 are not shown. Further, in FIG. 12, portions, of the lower clamp portions 943, 944, which contact with the banknotes B are indicated by hatching.

The second transport unit 8 transports the banknotes B to the second position as described above, as shown in FIGS. 6, 7 (see (A) of FIG. 12), and the banknotes B are thereafter moved, in the second horizontal direction, into the large tape loop L2. The holding unit 81 of the second transport unit 8 moves the banknotes B to a predetermined third position in the second horizontal direction, as shown in (B) of FIG. 12. At the third position, in the second horizontal direction, the tape T is positioned at almost the center, of the banknotes B, in the long edge direction.

The banknotes B are transported to the third position, and the holding unit 81 holds again a portion of the banknotes B other than a portion thereof which is to be bundled (a portion around which the tape T is wound in the subsequent handling), and the clamp unit 94 thereafter presses the banknotes B on both sides lateral thereto, in the stacking direction, that is, in the up-down direction. In the up-down direction, the upper clamp portion 941 and the lower clamp portions 943, 944 hold both side portions lateral, in the long edge direction of the banknotes B, to the portion of the banknotes B which is to be bundled. Thus, the banknotes B are pressed by the upper clamp portion 941 and the lower clamp portions 943, 944 in the up-down direction.

The lower clamp portions 943, 944 are integrated with the lower guide portion 926, whereby the lower guide portion 926 also moves upward according to the lower clamp portions 943, 944 moving upward. At this time, the paired feed rollers 920 draws back the tape T according to the lower guide portion 926 moving upward. As a result, as shown in FIG. 13, the tape loop L is reduced in size according to the lower guide portion 926 moving upward. In addition thereto, the second side guide portion 928 also moves upward according to the lower guide portion 926 moving upward. Thus, a space in which the tape loop L can be deformed, can be assured. That is, when a rate at which the lower guide portion 926 moves upward is too high as compared to a rate at which the tape loop L is reduced in size, the tape loop L is deformed so as to be beyond the guide unit 925. At this time, the second side guide portion 928 has been retracted from the lateral side of the tape loop L, and the tape loop L can thus expand toward a space in which the second side guide portion 928 has been positioned. Thus, bending of the tape T can be prevented.

Upward movement of the lower guide portion 926 is stopped together with the upward movement of the lower clamp portions 943, 944. Meanwhile, the tape T continues to be drawn back by the paired feed rollers 920 also after upward movement of the lower guide portion 926 is stopped. As shown in (C) of FIG. 12, the tape T is finally wound around the banknotes B.

—Joining of Tape, Cutting Thereof, and Stamping Thereon—

Subsequently, the tape T is joined by the heater 95 and the tape T is cut by the cutter 96. In addition thereto, the stamping unit 98 performs stamping on the tape T. FIG. 14 illustrates joining of the tape T, cutting thereof, and stamping thereon, and (A) thereof illustrates a state where the tape is pressed by a first and a second tape pressing portions, and (B) thereof illustrates a state where the tape is melt-adhered by the heater and the tape is cut by the cutter.

When winding of the tape T around the banknotes B has been completed, the heater 95 and the cutter 96 move downward together. At this time, the first and the second tape pressing portions 991, 992 also move downward together with the heater 95 and the cutter 96.

Firstly, as shown in (A) of FIG. 14, the first tape pressing portion 991 fits into the first recessed groove 922*c* of the base plate 922*a*, and sandwiches the tape T between the first tape pressing portion 991 and a bottom wall of the first recessed groove 922*c*. At the same time, the second tape pressing portion 992 sandwiches the tape T between the second tape pressing portion 992 and the upper surface of the pressing portion 923*b* of the movable portion 923. At this time, melt-adhesion by the heater 95 and cutting by the cutter 96 are not performed.

Subsequently, as shown in (B) of FIG. 14, the heater 95 sandwiches a portion, of the tape T, in which the leading end portion of the tape T overlaps the tape T that has been wound once, between the heater 95 and the base plate 922*a* of the tape holding unit 921. Specifically, the heater 95 sandwiches the tape T between the heater 95 and a portion of the base plate 922*a* which is positioned between the first recessed groove 922*c* and the second recessed groove 922*d*. The heater 95 melt-adheres an overlap portion of the tape T by heat.

The tape T is cut by the cutter 96 in parallel with melt-adhesion by the heater 95 due to heat. The cutter 96 cuts a portion, of the tape T, which is upstream of a portion melt-adhered by the heater 95, that is, a portion (hereinafter, referred to as a "remaining portion") not on the melt-adhered portion side but on the paired feed rollers 920 side. The cutter 96 is guided by the first and the second guide portions 923*c*, 923*d* into the second recessed groove 922*d*.

Thus, the tape T wound around the banknotes B is joined, and the remaining portion of the tape T is cut. The tape T with which the banknotes B are bundled has perforations, whereby the tape T can be easily cut by the perforations when the tape T is removed.

When joining and cutting of the tape T have been completed, the heater 95, the cutter 96, the first tape pressing portion 991, and the second tape pressing portion 992 move upward.

The stamping unit 98 performs stamping on the tape T in parallel with the melt-adhesion by the heater 95 and the cutting by the cutter 96. The stamping unit 98 has moved upward together with the lower guide portion 926, and is positioned vertically below the banknotes B when melt-adhesion and cutting of the tape T are performed. The tape T is drawn back by the paired feed rollers 920, and the tape T is wound around the banknotes B, and the stamping unit 98 thereafter moves the stamp 981 upward. The stamp 981 contacts with the tape T wound around the banknotes B and performs stamping on the tape T.

—Discharging of Banknote—

The bundled banknotes B bundled with the tape T are transported to the outlet portion 11 by the second transport unit 8 and the third transport unit 10.

That is, when joining of the tape T, cutting thereof, and stamping thereon have been completed, the holding unit 81 holds the bundled banknotes B, which is not shown in detail. Subsequently, the lower clamp portions 943, 944 move downward, and pressing by the clamp unit 94 is released. Thereafter, the holding unit 81 transports the bundled banknotes B by a predetermined distance in the second horizontal direction toward a side opposite to a side toward which the banknotes has been transported into the large tape loop L2.

Next, holding of the bundled banknotes B by the holding unit 81 is released. Instead thereof, the third transport unit 10 holds the bundled banknotes B.

Subsequently, the third transport unit 10 transports the bundled banknotes B toward the outlet portion 11 in the first horizontal direction. When the bundled banknotes B approach the outlet portion 11, holding of the bundled banknotes B by the third transport unit 10 is gradually released. The bundled banknotes B are finally pushed onto the outlet portion 11 by the third transport unit 10.

The bundled banknotes that have been pushed onto the outlet portion 11 are discharged to the outside of the housing 12 through the outlet portion 11.

<Configuration (No. 1) for Preventing Tape T from Having Deformation>

As described above, while bundling of banknotes is not performed, the tape T drawn from the tape roll TR is in the stand-by state in which the leading end thereof is at a predetermined position near the first tape sensor 9210, the tape T is arranged continuously along the transport path between the reel unit and the tape loop forming unit 92, and tensile force is applied thereto so as to generate no slack. The tape T has a paper layer as a base of the tape and an adhesive layer, and is relatively not limp, and the tape T may have deformation while the tape T remains stationary in a state where tensile force is applied thereto. In particular, in the banknote handling apparatus 100 described herein, due to the layout thereof, the tape T is twisted between the reel unit and the tape transport unit 912, and a specific portion of the tape T in the stand-by state, specifically, a portion between the change roller 9116 and the tape transport unit 912, as shown in FIG. 3, may be deformed so as to have torsional deformation. In addition to the torsional deformation, the tape T may be deformed so as to be bent along the transport path as a result of the tape T being arranged continuously along the transport path.

When the tape T that is deformed so as to have torsional deformation is supplied to the tape loop forming unit 92 and formed into the tape loop L, the tape T that is arranged from the second corner guide portion 929*b* through the second side guide portion 928 along the fourth corner guide portion 929*d* and the like is prevented from being detected by the second tape sensor 9211, so that, although the large tape loop L2 has been formed so as to have a predetermined shape, the second tape sensor 9211 may not detect the tape T. For example, the above-described case is a case where, in the state shown in FIG. 11, the position of the tape T is deviated relative to the second tape sensor 9211 in the direction orthogonal to the surface of the sheet. In this case, as described above, the tape T is drawn back and the tape loop L is formed again. This causes delay in the banknote bundling. In a case where, even if the tape loop L is formed again, the deformation generated in the tape T prevents the second tape sensor 9211 from detecting the tape, error occurs, and an operator needs to open the housing 12 of the banknote handling apparatus 100 and cut and remove a portion, of the tape T, having the deformation. This also causes delay in the banknote bundling.

In addition to erroneous detection by the second tape sensor 9211, due to the deformation generated in the tape T, the large tape loop L2 may not be actually formed into a predetermined shape, or the tape may not accurately overlap when the tape T is melt-adhered by the heater 95, to interfere with the joining. Further, the orientation of the tape T relative to the cutter 96 may deviate when the tape T is cut by the cutter 96, to interfere with cutting of the tape T.

Therefore, the banknote handling apparatus 100 is configured to prevent or inhibit the tape T from having deformation while bundling of banknotes is not performed. Specifically, the tape setting unit 911 rotates the tape roll TR by a predetermined distance in a direction in which the tape T is fed, so as to reduce tensile force in the tape T in the stand-by state. At this time, the tape transport unit 912 does not transport the tape T. Thus, tensile force is not substantially applied to the tape T or tensile force is reduced in the tape T particularly between the change roller 9116 and the tape transport unit 912, whereby the tape T in the stand-by state is prevented or inhibited from having deformation.

The specific operation (in the description therein, an operation of rotating the tape roll TR in the feeding direction) for reducing tensile force in the tape T is performed at a predetermined time while bundling of banknotes is not performed. Specifically, in a case where a predetermined time period has elapsed in a state where bundling of banknotes is not performed, the tape setting unit 911 rotates the tape roll TR to reduce tensile force in the tape T. Thus, tensile force in the tape T can be reduced before the tape T has the deformation. Meanwhile, when the bundling operation is started before elapse of the predetermined time period, the tape T can be immediately supplied to the tape loop forming unit 92.

When the operation of bundling the banknotes is restarted after tensile force in the tape T in the stand-by state is reduced by the tape roll TR being rotated in the feeding direction, the tape setting unit 911 rotates the tape roll TR in the winding direction, to remove slack of the tape T, and the paired feed rollers 920 of the tape transport unit 912 thereafter feeds the tape T to the tape loop forming unit 92 as described above. Thus, a feeding amount of the tape T can be accurately controlled.

As described above, the tape T has a paper layer and an adhesive layer, and the paper layer and the adhesive layer absorb moisture, whereby the tape T is likely to have deformation. Therefore, in a high-humidity environment, or when change in humidity is great, the tape T is likely to have deformation. Also when the ambient temperature is high or change in temperature is great, the tape T is likely to have deformation. Therefore, as imaginarily shown in FIG. 5, a temperature sensor 1003 that detects an ambient temperature and a humidity sensor 1004 that detects an ambient temperature may be provided, and a time when the specific operation is to be executed may be determined according to a result of detection by the temperature sensor 1003 and a result of detection by the humidity sensor 1004. Specifically, when the temperature is relatively high and/or when the humidity is relatively high, or when change in temperature is great and/or when change in humidity is great, a time when tensile force in the tape T is reduced may be accelerated (that is, the predetermined time period in a case where a predetermined time period has elapsed in a state where bundling of banknotes is not performed as described above, is shortened). Thus, in an environment where the tape T is likely to have deformation, reduction of tensile force in the tape T is accelerated, and the tape T can be effectively prevented from having deformation. The time can be set by changing a default of the predetermined time period according to a temperature and a humidity detected by the sensors. The time when tensile force is to be reduced may be determined on the basis of only a temperature or only a humidity, instead of both a temperature and a humidity.

The temperature sensor 1003 and the humidity sensor 1004 may detect a temperature and a humidity of the outside of the housing 12 of the banknote handling apparatus 100 or may detect a temperature and a humidity inside the housing 12 of the banknote handling apparatus 100, in particular, may detect a temperature and a humidity near the tape roll TR, or a temperature and a humidity near the transport path from the reel unit to the tape loop forming unit 92.

Unlike reduction in tensile force in the tape T in the case of a predetermined time period having elapsed in a state where bundling of banknotes is not performed, when one transaction in which bundling of banknotes is performed, has ended, the tape setting unit 911 may rotate the tape roll TR to reduce tensile force in the tape T. Thus, also when a relatively long time elapses before start of the subsequent transaction, the tape T can be prevented from having deformation. No slack is in the tape T in the stand-by state while bundling is performed in one transaction, whereby the tape T can be immediately supplied to the tape loop forming unit 92. As a result, banknotes can be smoothly bundled during one transaction.

The tape setting unit 911 may rotate the tape roll TR to reduce tensile force in the tape T each time bundling of banknotes has been completed instead of when one transaction has ended.

Further, the tape setting unit 911 may reduce tensile force in the tape T when an operator sets a new tape roll TR in the tape setting unit 911 and, further, the opening and closing lid 121 has been closed. That is, as described above, when the new tape roll TR is set in the tape setting unit 911, the tape transport unit 912 transports the tape T toward the tape loop forming unit 92 until the leading end of the tape T is detected by the first tape sensor 9210, and the tape roll TR is thereafter rotated by the stepping motor of the tape setting unit 911 in a direction in which the tape T is wound, thereby removing slack of the tape T in the mid-portion thereof. Thereafter, the tape setting unit 911 may rotate the tape roll TR in the feeding direction to reduce tensile force in the tape T. A certain time period may elapse before banknotes are actually bundled after setting of the tape roll TR. In a case where tensile force in the tape T is previously reduced when the tape roll TR is set, the tape T can be prevented from having deformation and the subsequent banknote bundling operation can be smoothly performed.

Further, the tape setting unit 911 may reduce tensile force in the tape T by rotating the tape roll TR in the feeding direction when the operation unit power switch 1002 of the banknote handling apparatus 100 is switched off. In the banknote handling apparatus 100, the operation unit power switch 1002 is switched off in a time other than business hours in a bank or the like, whereby the tape T that is not used for a relatively long time can be prevented from having deformation while the tape T is not used. As a result, when the operation unit power switch 1002 of the banknote handling apparatus 100 is switched on and the banknote bundling operation is restarted, the tape T does not have deformation, whereby the bundling operation can be smoothly performed.

As an example of a time when the specific operation that is an operation of rotating the tape roll TR by the tape setting unit 911 is executed, (1) "when a predetermined time period has elapsed in a state where bundling of banknotes is not performed", (2) "when one transaction in which bundling of banknotes is performed has ended", (3) "each time bundling of banknotes has been completed", (4) "when the tape roll TR is set in the tape setting unit 911", and (5) "when the operation unit power switch 1002 of the banknote handling apparatus 100 is switched off", are described. These times may be optionally combined within a possible range.

<Configuration (No. 2) for Preventing tape T from Having Deformation>

In the above-described configuration, in order to reduce tensile force in the tape T in the stand-by state, the tape setting unit 911 rotates the tape roll TR in the feeding direction. Unlike this, also by the tape transport unit 912 transporting the tape T toward the tape setting unit 911 over a predetermined distance, tensile force in the tape T can be reduced particularly between the change roller 9116 and the tape transport unit 912. At this time, the tape setting unit 911 is not driven.

As a time when the tape transport unit 912 reduces tensile force in the tape T, each of times (1) to (5) described above can be adopted. These times can be optionally combined within a possible range. As described above, a time when tensile force in the tape T is to be reduced may be determined according to a result of detection by the temperature sensor 1003 and/or the humidity sensor 1004.

The leading end of the tape T is deviated from a predetermined position near the first tape sensor 9210 by the tape transport unit 912 transporting the tape T backward. Therefore, when banknote bundling operation is restarted after tensile force in the tape T in the stand-by state is reduced by the tape transport unit 912 transporting the tape T backward, the tape transport unit 912 firstly transports the tape T in the feeding direction until the leading end of the tape T is detected, and the tape roll TR is thereafter rotated in the direction in which the tape T is wound, by the stepping motor for the tape setting unit 911, whereby slack is removed in the mid-portion of the tape T, and the paired feed rollers 920 of the tape transport unit 912 may then feed the tape T toward the tape loop forming unit 92 as described above. In a case where, when the tape transport unit 912 transports the tape T in the feeding direction until the leading end of the tape T is detected, slack in the mid-position of the tape T is removed, an operation of rotating the tape roll TR in the direction in which the tape T is wound, may be omitted.

<Configuration for Changing Portion where Tape T has Deformation>

As described above, in the banknote handling apparatus 100, the tape T is twisted in a portion between the change roller 9116 and the tape transport unit 912, whereby the torsional deformation generated near the portion is positioned at the guide unit 925 when the large tape loop L2 is formed, more precisely, when the large tape loop L2 is formed for the second time after the bundling operation is restarted, and erroneous detection by the second tape sensor 9211 may be thus caused. That is, in a case where, in a state where the leading end of the tape T is positioned at the first tape sensor 9210, the tape T has torsional deformation at a specific portion, erroneous detection by the second tape sensor 9211 may be caused.

Instead of reduction of tensile force in the tape T in the stand-by state as described above, a portion in which the tape T has deformation may be changed to avoid interference with detection by the second tape sensor 9211. Specifically, the stand-by position of the tape T is changed as appropriate while bundling of banknotes is not performed. In the banknote handling apparatus 100, a predetermined stand-by position (default position) of the tape T is a predetermined position of the leading end of the tape T near the first tape sensor 9210 as described above. Thus, when forming of the tape loop L is started, the tape loop forming unit 92 can immediately supply the tape T. In order to change the stand-by position of the tape T, the tape transport unit 912 transports the tape T by a predetermined distance in one of a feeding direction in which the tape T is transported toward the tape loop forming unit, or a drawing-back direction in which the tape T is transported toward the tape setting unit 911. According to the transport operation by the tape transport unit 912, the tape setting unit 911 is also driven. Thus, a predetermined tensile force is applied to the tape T.

Thus, in a case where the stand-by position of the tape T is changed from the default position, even when the tape T has torsional deformation, a portion in which the tape T has the torsional deformation is different from a specific portion in which the tape T has the torsional deformation in the case of the tape T being in the stand-by state at the default position. As a result, interference with detection by the second tape sensor 9211 provided near the fourth corner guide portion 929*d*, due to the torsional deformation generated in the tape T, can be prevented or inhibited.

The operation of changing the stand-by position of the tape T may be executed at a predetermined time while bundling of banknotes is not performed. As described above, one or some of (1) "when a predetermined time period has elapsed in a state where bundling of banknotes is not performed", (2) "when one transaction in which bundling of banknotes is performed has ended", (3) "each time bundling of banknotes has been completed", (4) "when the tape roll TR is set in the tape setting unit 911", and (5) "when the operation unit power switch 1002 of the banknote handling apparatus 100 is switched off", may be adopted.

When the stand-by position of the tape T is periodically changed, a time period in which the tape T continuously remains stationary at a predetermined stand-by position can be shortened, whereby the tape T can be prevented or inhibited from having deformation. While bundling of banknotes is not performed, the tape transport unit 912 may sequentially change the stand-by position of the tape T at predetermined time intervals. The stand-by positions of the tape T which are sequentially changed may be different from each other, or, for example, two stand-by positions are preset, and the two stand-by positions may be alternately used. The number of the preset stand-by positions is not limited to two, and can be determined as three or more in an appropriate range.

<Configuration for Correcting Deformation Generated in Tape T>

In each configuration described above, the tape T or a specific portion of the tape T is prevented or inhibited from having deformation. Unlike this, when the tape T has deformation, the deformation may be corrected, and the tape T may be then supplied to the tape loop forming unit 92. Specifically, when bundling of banknotes is started after a predetermined time period or longer period has elapsed in a state where bundling of banknotes is not performed, the tape transport unit 912 reciprocates the tape T so as to move the tape T forward and backward in the transport path before the tape T is fed toward the tape loop forming unit 92. Thus, the deformation generated in the tape T is corrected while the tape T passes through the paired rollers and the guides that form the transport path. The reciprocation may be performed once or plural times, and the number of times of the reciprocation can be determined as such an appropriate number of times as to correct the deformation.

Thus, even when the tape T has deformation, the deformation is corrected before the tape T is supplied to the tape loop forming unit 92, thereby avoiding malfunction caused by the deformation generated in the tape T. That is, erroneous detection by the second tape sensor 9211 can be avoided, the large tape loop L2 can be assuredly formed, the tape T can be assuredly melt-adhered due to heat, and the tape T can be assuredly cut.

That a predetermined time period or longer period has elapsed in a state where bundling of banknotes is not performed also means that a predetermined time period or longer period has elapsed in a state where the operation unit power switch 1002 of the banknote handling apparatus 100 is off as well as that a predetermined time period or longer period has elapsed in a state where bundling is not performed in the case where the operation unit power switch 1002 of the banknote handling apparatus 100 is on. Therefore, when the operation unit power switch 1002 of the banknote handling apparatus 100 is switched on and bundling is started, correction operation is performed by the tape transport unit 912.

In a case where the tape T clearly has no deformation when the tape T is supplied to the tape loop forming unit 92, for example, in a case where supplying of the tape T is started before the predetermined time period or longer period has elapsed in a state where bundling of banknotes is not performed, supplying of the tape T may be started without performing the above-described correction operation. The above-described correction operation may be performed before supplying of the tape T, regardless of whether or not the predetermined time period or longer period has elapsed in a state where bundling of banknotes is not performed.

The configuration for correcting deformation of tape T may be combined with the "configuration (No. 1) for preventing tape T from having deformation", the "configuration (No. 2) for preventing tape T from having deformation", and the "configuration for changing portion where tape T has deformation" described above. That is, the tape T may be prevented from having deformation and a portion in which the tape T has deformation may be changed while the tape T is in the stand-by state, and, further, the deformation generated in the tape T may be corrected and the tape T may be then supplied when supplying of the tape T is started for banknote bundling.

<Configuration for Avoiding Erroneous Detection by Sensor>

As described above, in the banknote handling apparatus 100, generation of torsional deformation in the tape T may cause erroneous detection by the second tape sensor 9211. In particular, the erroneous detection may occur when a portion in which torsional deformation is generated in the tape T in the stand-by state reaches the guide unit 925 of the tape loop forming unit 92, specifically, when the large tape loop L2 is formed for the second time after bundling of banknotes is restarted. Therefore, when erroneous detection by the second tape sensor 9211 is likely to occur, the tape loop L may be formed regardless of a result of detection by the second tape sensor 9211.

Specifically, in a case where bundling of banknotes is performed after a predetermined time period or longer period has elapsed in a state where bundling of banknotes is not performed (in the description herein, a state where bundling of banknotes is not performed also means a state where the operation unit power supply of the banknote handling apparatus 100 is off), the tape loop forming unit 92 forms the large tape loop L2, regardless of a result of detection by the second tape sensor 9211, until the large tape loop L2 is formed twice after the restart. That is, even if the second tape sensor 9211 has not detected the tape T and does not detect that the large tape loop L2 having a predetermined shape has been formed, bundling of banknotes is advanced as it is without forming the tape loop L again as described above. Banknotes are inserted into the large tape loop L2 and the tape T is wound back, to form a bundle of banknotes. After the large tape loop L2 is formed for the second time and banknotes are bundled, when the large tape loop L2 is formed for the third and the subsequent times, a result of detection by the second tape sensor 9211 is used as described above. Thus, when erroneous detection by the second tape sensor 9211 is likely to occur, bundling of banknotes can be prevented from being interrupted due to the erroneous detection, whereby bundling of banknotes can be smoothly performed.

When the large tape loop L2 having a predetermined shape is not actually formed while a result of detection by the second tape sensor 9211 is ignored, a problem may arise, for example, when banknotes are then inserted or when the tape T is then wound back, and error occurs at that time. In this case, an operator needs to halt the banknote handling apparatus 100 and release the error. However, since a state where the large tape loop L2 having a predetermined shape is not actually formed, rarely occurs, occurrence of a state where the large tape loop L2 having a predetermined shape is not actually formed while a result of detection by the second tape sensor 9211 is ignored, may be rarely repeated. Therefore, a substantial influence is rarely caused by ignoring a result of detection by the second tape sensor 9211.

The number of times a result of detection by the second tape sensor 9211 is ignored, is not limited to two, and may be set as an appropriate number of times.

The configuration in which a result of detection by the second tape sensor 9211 is ignored, may be combined with the "configuration (No. 1) for preventing tape T from having deformation", the "configuration (No. 2) for preventing tape T from having deformation", the "configuration for changing portion where tape T has deformation", and the "configuration for correcting deformation of tape T" described above. That is, the tape T is prevented from having deformation and a portion where the tape T has deformation is changed while the tape T is in the stand-by state, and, further, deformation generated in the tape T is corrected before supplying of the tape T is started, and, in addition thereto, a result of detection by the second tape sensor 9211 is ignored for a predetermined number of times after start of supplying of the tape T, whereby the tape loop L may be formed.

<Configuration Associated with Power Saving Mode of Banknote Handling Apparatus 100>

The banknote handling apparatus 100 has a power saving mode. Specifically, when a predetermined time period has elapsed in an idle state in which handling such as counting of banknotes and bundling thereof is not performed, the banknote handling apparatus 100 shifts to the power saving mode. In the power saving mode, power conduction in the heater 95 is switched off, thereby reducing consumption of stand-by power. The temperature of the heater 95 for which power conduction is switched off is reduced.

When the power saving mode is restored to a normal mode in order to start counting or bundling, power conduction in the heater 95 is started. However, the banknote handling apparatus 100 does not start handling until the temperature of the heater 95 reaches a predetermined temperature at which melt-adhesion of the tape T due to heat can be performed. Therefore, it is inconvenient to await start of the handling during the restoration from the power saving mode. Start of the handling is awaited until the temperature of the heater 95 rises to a predetermined temperature also when the operation unit power switch 1002 is switched on as well as during restoration from the power saving mode.

Melt-adhesion of the tape T is performed by the heater 95 after at least stacking of banknotes is ended, and time lag is generated between start of taking-in of banknotes, or the like, and melt-adhesion of the tape T by the heater 95. Focusing thereon, the banknote handling apparatus 100 is configured to start handling in a possible range without awaiting rising of the temperature of the heater 95, during restoration from the power saving mode and when power supply is switched on. That is, during restoration from the power saving mode and when the operation unit power switch 1002 is switched on, taking-in of banknotes placed on the hopper unit 2 is immediately started, and recognition of the banknotes, transporting thereof, and stacking thereof are sequentially performed as described above. During these periods, power conduction in the heater 95 is performed. Thus, the temperature of the heater 95 rises. A predetermined number of banknotes are then stacked in the bundling stacker 4, and, when the banknotes are bundled, the temperature of the heater 95 has risen to a predetermined temperature, and, subsequent thereto, the bundling of banknotes and melt-adhesion of the tape T can be performed.

In a case where the temperature of the heater has not reached the predetermined temperature when bundling is to be performed by using the tape T after stacking of the banknotes has ended, rising of the temperature of the heater is awaited at that time. In this case, the operation of the banknote handling apparatus 100 may be halted, or the operations (for example, recognition, transporting, stacking) other than the bundling of the banknotes may be continuously performed if the operations other than the bundling of the banknotes can be continued as they are.

Thus, in the banknote handling apparatus 100 having the power saving mode, start of the handling of the banknote handling apparatus 100 is not awaited during the restoration from the power saving mode, whereby both improvement of usability and reduction in power consumption can be allowed. Also when the operation unit power switch 1002 is switched on, the handling can be immediately started, thereby improving usability.

<Printing on Tape for Bundled Banknotes>

On the tape T for the bundled banknotes B obtained according to the above-described procedure, information associated with the bundled banknotes B is printed. The printed content includes one item or a plurality of items. Specifically, the item is: a name of an operator who performs an operation for bundling banknotes into the bundled banknotes B; a serial number (that is, a bundle number) of the bundled banknotes B bundled by the banknote handling apparatus 100; a date when the bundled banknotes have been obtained; a time when the bundled banknotes B have been obtained; a name of a financial facility (for example, the name of the bank, the name of the bank may include a name of the branch) at which banknotes have been bundled into the bundled banknotes B; a monetary amount of the bundled banknotes B (that is, the sum of the monetary amounts); fitness or unfitness of banknotes included in the bundled banknotes B; or the like. Items other than the above-described exemplary items may be included. A user (in the description herein, the user corresponds to a staff member who sets printed contents in the financial facility in which the banknote handling apparatus 100 is used to perform depositing (that is, bundling)), selects any desired items from among a plurality of candidate items. The information of the selected items is stored in the memory unit 1201 of the control unit 120. The printing unit 97 performs printing at a predetermined position of the tape T according to the information of the items stored in the memory unit 1201. The plurality of items are printed so as to be aligned along the tape T. For example, a space is provided between the items. The greater the number of items to be printed on the tape T is, the longer the length for printing is. The "length for printing" represents a length from one end to the other end of the entirety of a character string that forms one item or a plurality of items aligned along the tape T.

Figure 15:
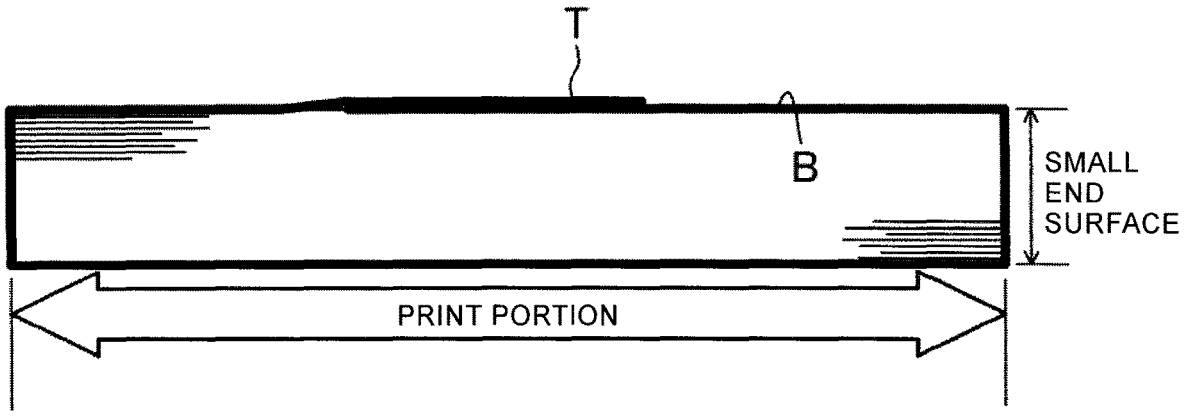
FIG. 15 illustrates a range of a print portion for bundled banknotes.

As shown in FIG. 15, a range, in the tape T, in which printing is performed for the bundled banknotes B is restricted to a tape portion positioned on the banknote face side or the banknote back side of the bundled banknotes B. In the example shown in FIG. 15, the range in which printing is performed is a range, of the tape portion positioned on the lower surface of the bundled banknotes B, from the right end to the left end of the bundled banknotes B. Thus, no printing is basically performed on the tape portion positioned on the side surfaces (that is, small end surfaces) of the bundled banknotes B. This is because a plurality of obtained bundles of the banknotes B may be stacked and a tape may be wound around the plurality of bundles to form a larger bundle. In the larger bundle, a bar code or the like may be attached to the tape portion positioned on the small end surface of the bundled banknotes B.

Thus, the range on which the printing is performed for the bundled banknotes B is defined by the dimension, of the banknotes, in the short edge direction. However, when the length for printing on the tape T is long as described above, the length does not fit into a range of a print portion, and may enter the small end surface.

The dimension of the banknote in the short edge direction may be different according to denominations. When banknotes of a denomination for which the dimension in the short edge direction is relatively long are bundled into the bundled banknotes B, the printing can be performed within the range of the print portion. Meanwhile, when banknotes of a denomination for which the dimension in the short edge direction is relatively short are bundled into the bundled banknotes B, the printing may not be performed within the range of the print portion.

The banknote handling apparatus 100 is configured so as to perform no printing on the small end surface of the bundled banknotes B. Specifically, the banknote handling apparatus 100 is configured to set priorities of a plurality of selected items as well as allow a user to select items to be printed on the tape T. The priorities are for elimination from items to be printed when the length for printing does not fit into the range of the print portion for the bundled banknotes B, and an item having a low priority is preferentially eliminated.

The banknote handling apparatus 100 sets the length for printing on the tape T according to: printed items set by a user and priorities of the items; and a dimension, in the short edge direction, of the banknotes to be bundled, such that printing is not performed on the tape portion positioned on the small end surface. The information of a dimension of a banknote in the short edge direction can be obtained based on size information, for each banknote, which is previously stored in the memory unit 1201, and a result of recognition performed by the recognition unit 3. The size information, for each banknote, which is previously stored in the memory unit 1201 may be obtained from the recognition template 33. The banknote handling apparatus 100 can also obtain a dimension of a banknote in the short edge direction in various methods. For example, a user may manually input a dimension of a banknote in the short edge direction.

Figure 16:
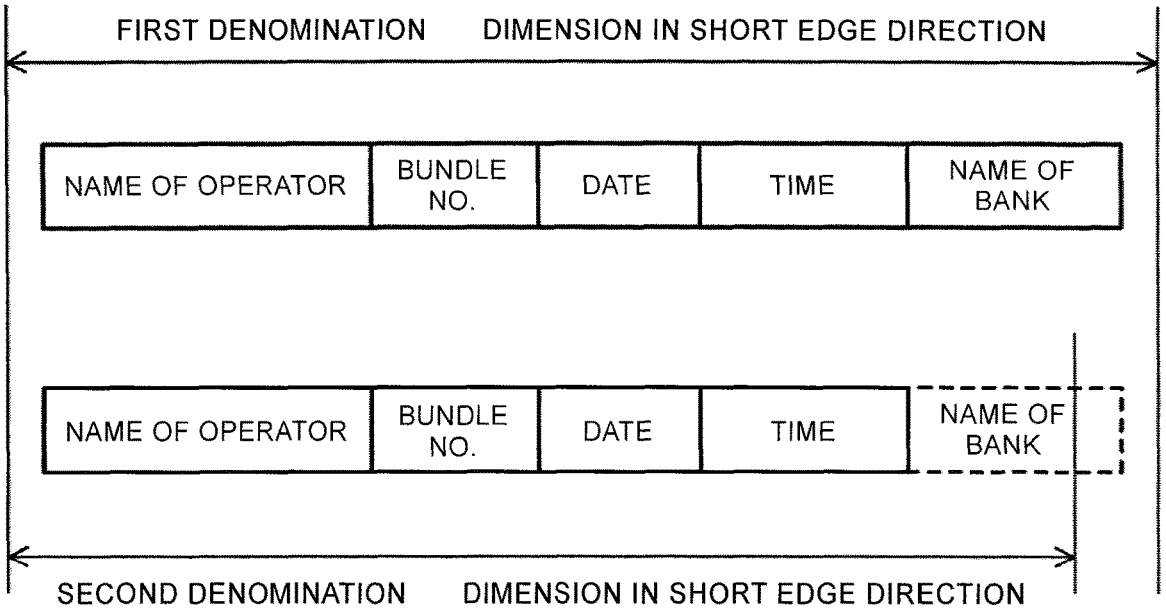
FIG. 16 illustrates examples of items printed on the tape for two kinds of banknotes having widths different from each other.

FIG. 16 shows examples of items printed for banknotes, of two denominations, having different dimensions in the short edge direction. In the description herein, examples of items printed on the tape T for banknotes of a first denomination, and items printed on the tape T for banknotes of a second denomination, are shown. In the illustrated examples, a user selects "name of operator", "bundle No.", "date", "time", and "name of bank", as items to be printed. It is assumed that, among them, "name of bank" has a priority that is set to be lowest.

Even when all the selected items are printed for the bundled banknotes, of the first denomination, having relatively long dimension in the short edge direction, the length for printing falls within the range of the print portion for the bundled banknotes B. When banknotes of the first denomination are bundled into the bundled banknotes B, the banknote handling apparatus 100 prints, on the tape T, all the items selected by the user. Thus, printing can be performed on only the tape portion positioned on the banknote face side or the banknote back side of the bundled banknotes B without performing printing on the tape portion positioned on the small end surface.

Meanwhile, even if printing of all the selected items is attempted, since the banknotes of the second denomination have a relatively short dimension in the short edge direction, the length for printing does not fit into the range of the print portion for the bundled banknotes B. Therefore, the banknote handling apparatus 100 eliminates, according to the priorities having been set, the item "name of banknote" having the lowest priority from the items to be printed (see the dashed line in FIG. 16). The length for printing is shortened by reducing the number of items to be printed, and printing can be performed on only the tape portion positioned on the banknote face side or the banknote back side of the bundled banknotes B, of the second denomination, having the relatively short dimension in the short edge direction, without performing printing on the tape portion positioned on the small end surface.

Further, the banknote handling apparatus 100 is configured to allow the length for printing to be adjusted not only by increasing or decreasing the number of items to be printed, but also by adjusting the length of the item, so as not to perform printing on the tape portion positioned on the small end surface of the bundled banknotes B. Adjustment of the length of the item includes shortening of the length of the item by narrowing an empty space corresponding to the number of remaining characters when the number of characters used by a user is less than the maximum number of characters which is preset for the item. Specifically, in the description herein, the item "name of operator" and the item "name of bank" correspond to such an item. For these items, the maximum number of characters is preset, and a user is allowed to optionally set a content within the range of the maximum number of characters. For example, the maximum number of characters is set as 10 for the item of name of operator, and, when a user sets a name of an operator having six characters, the number of remaining characters corresponds to four.

Adjustment of the length of the item includes shortening of the length of the item by narrowing an empty space corresponding to the number of remaining digits when the number of digits to be printed for an item having the number of digits which varies within a predetermined maximum number of digits, is less than the maximum number of digits. Specifically, in the description herein, the items "bundle No.", "date", and "time" correspond to such an item. The bundle No. is a serial number for the bundled banknotes as described above, and the number of digits thereof can be varied. The date includes single-digit dates (1, 2, and the like) and double-digit dates (11, 12, and the like). The time includes one-digit hours, minutes, and seconds, and double-digit hours, minutes, and seconds, similarly to the date. For example, for the item representing the bundle No., in a case where the maximum number of digits is set as three, when the number of digits for the serial number is one, the number of remaining digits corresponds to two.

Figure 17:
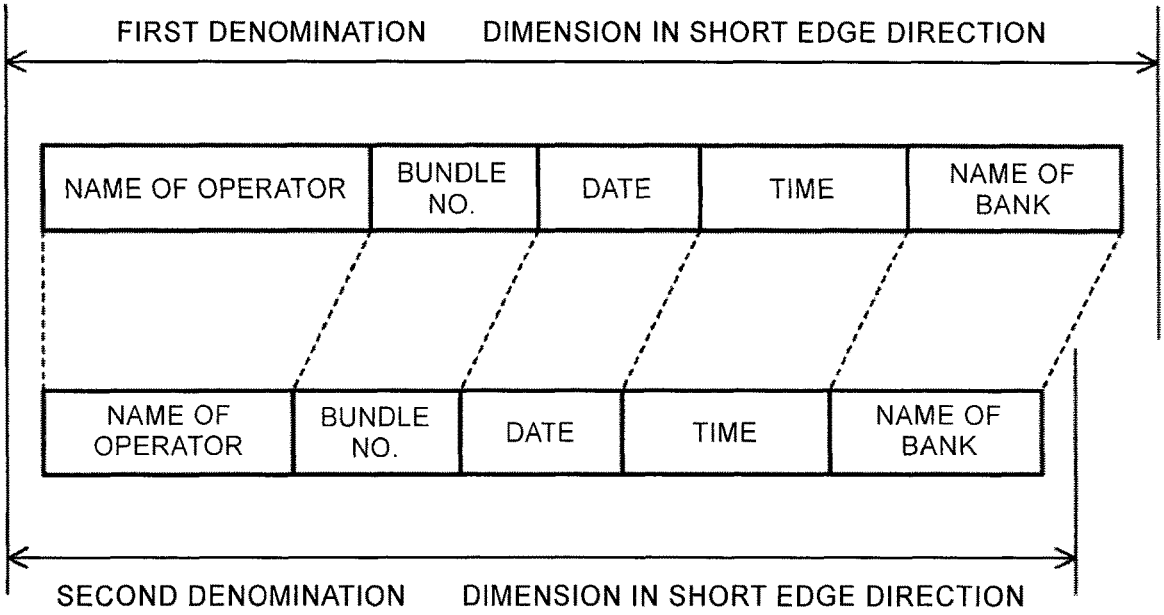
FIG. 17 illustrates examples of lengths for printing on the tape for two kinds of banknotes having widths different from each other.

FIG. 17 illustrates an exemplary case where the length of the item representing a name of an operator is changed between the bundled banknotes B of the first denomination and the bundled banknotes B of the second denomination. That is, the dimension, in the short edge direction, of the bundled banknotes B of the first denomination is relatively long, and a range of the print portion is relatively wide. Therefore, for the item representing a name of an operator, an empty space corresponding to the number of remaining characters is included to use the length of the maximum number of characters as the length of this item. Although the length of the item representing a name of an operator is long, printing can be performed on only the tape portion positioned on the banknote face side or the banknote back side of the bundled banknotes B without performing printing on the tape portion positioned on the small end surface.

Meanwhile, the dimension, in the short edge direction, of the bundled banknotes B of the second denomination is relatively short, and a range of the print portion is relatively narrow. Therefore, for the item representing a name of an operator, an empty space corresponding to the number of remaining characters is narrowed and the length of this item is thus made relatively short. Thus, printing can be performed on only the tape portion positioned on the banknote face side or the banknote back side of the bundled banknotes B without performing printing on the tape portion positioned on the small end surface. As shown in FIG. 17, the length for printing is shortened by shortening the length of the item, whereby all the items selected by a user can be printed without eliminating some of the items.

When the empty space corresponding to the number of remaining characters or the number of remaining digits is narrowed, the empty space may be entirely narrowed or the empty space may be partially narrowed.

In the banknote handling apparatus 100, increasing or decreasing of the number of items to be printed according to the priorities described above, and narrowing of an empty space corresponding to the number of remaining characters or the number of remaining digits for an item are combined, whereby printing is performed on only the tape portion positioned on the banknote face side or the banknote back side without performing printing on the tape portion positioned on the small end surface of the bundled banknotes B. One of increasing or decreasing of the number of items to be printed according to the priorities, or narrowing of an empty space corresponding to the number of remaining characters for an item may be performed, instead of both of them being performed.

Figure 18:
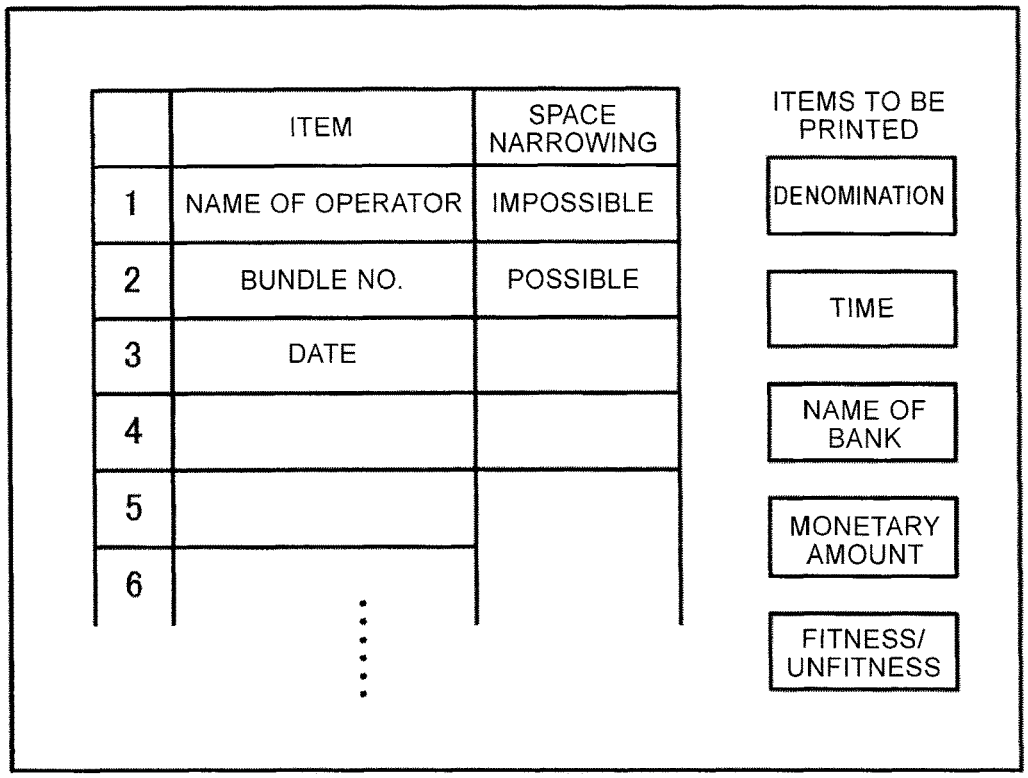
FIG. 18 illustrates an example of a screen on which priorities of items to be printed are set.

FIG. 18 illustrates an example of a screen for allowing setting of a mode in which printing on the tape T for the bundled banknotes B is performed, and, for example, the screen is displayed on the touch panel 17 of the banknote handling apparatus 100. The screen for setting is configured to allow selection of items to be printed, and setting of priorities of the items. That is, the numbers, 1, 2, 3, . . . on the left side of a table on the screen represent priorities, respectively, and items are inputted in cells corresponding to the numbers, whereby selection of the items to be printed and setting of the priorities of the items are simultaneously performed. In other words, the priorities can be set for only the items to be selected for the printing.

As shown in the drawings, when candidates of items which can be selected as items to be printed are displayed on the screen for setting, a user is allowed to select desired items from among the candidates, thereby improving usability. The screen for setting is an exemplary one, and is not limited to this example.

For selected items, setting as to whether or not an empty space corresponding to the number of remaining characters is to be narrowed (see a column for "space narrowing") as described above, can be performed. That is, when the space narrowing is set as "possible", an empty space corresponding to the number of remaining characters or the number of remaining digits can be narrowed for the item. Further, in this case, setting may be performed such that the empty space is always narrowed regardless of whether or not the length for printing falls within a range of the print portion, or setting may be performed such that the empty space is narrowed when the length for printing does not fit into a range of the print portion, and the empty space is not narrowed when the length for printing falls within the range. When the space narrowing is set as "impossible", setting is such that an empty space corresponding to the number of remaining characters or the number of remaining digits is not narrowed for the item. For an item for which an empty space corresponding to the number of remaining characters or the number of remaining digits is not generated, setting in the cell for space narrowing is void or setting therefor cannot be performed.

Figure 19:
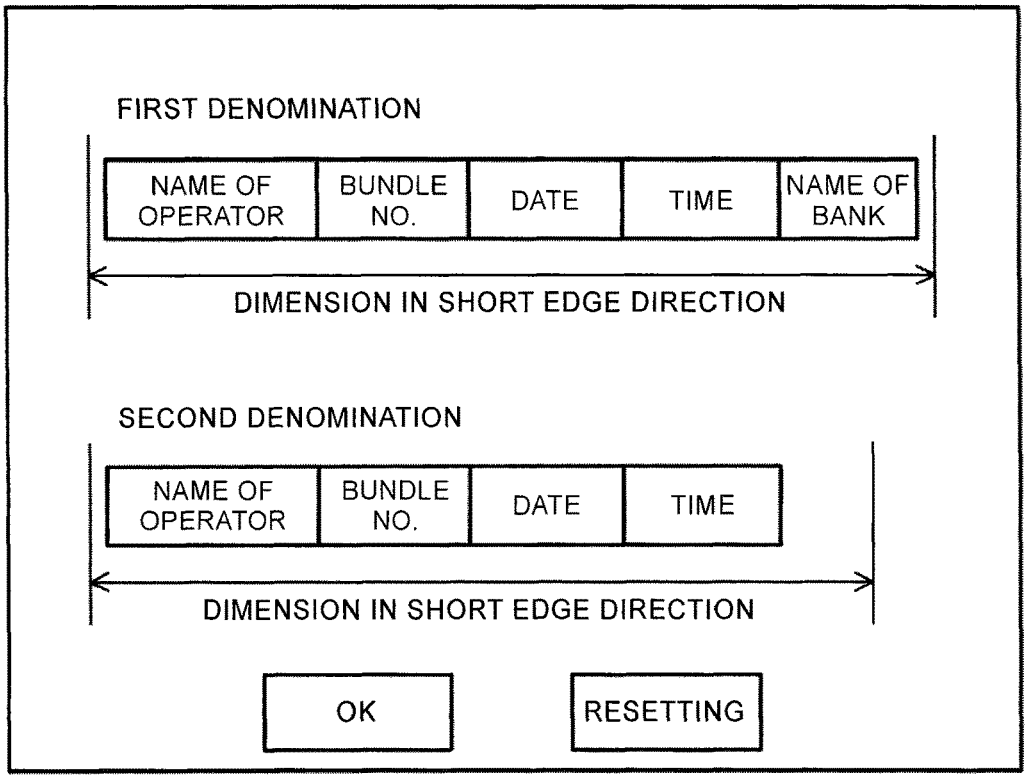
FIG. 19 illustrates an example of a screen, for setting, on which a printing state based on the priorities having been set is displayed.

FIG. 19 illustrates an example of a screen which can be displayed on the touch panel 17 when a user is setting items to be printed, on the screen for setting shown in FIG. 18. On the screen, a state of printing performed on the tape T for the bundled banknotes B according to a printing mode which is set by the user is displayed for each of denominations for which the dimensions in the short edge direction are different. FIG. 19 illustrates an example of a screen displayed when items to be printed are increased or decreased according to the priorities which have been set by a user. This example indicates that all the items, "name of operator", "bundle No.", "date", "time", and "name of bank", which have been set by the user, are printed for the bundled banknotes B, of the first denomination, having a relatively long dimension in the short edge direction. Meanwhile, for the bundled banknotes B, of the second denomination, having a relatively short dimension in the short edge direction, the range of the print portion is narrow, whereby the items, "name of operator" "bundle No.", "date", and "time", are printed so as to eliminate "name of bank" from "name of operator", "bundle No.", "date", "time", and "name of bank" which have been set by the user. The user is allowed to previously confirm, on the screen, a state of actual printing on the tape T for the bundled banknotes B. Two buttons, "OK" and "resetting", are displayed on the screen. When the user desires to, for example, correct the set items to be printed, based on the mode confirmed on the screen, the user selects and operates "resetting" button. Thus, the screen can be returned to the screen for setting shown in FIG. 18, and the user is allowed to perform setting of a mode for printing (including newly resetting, and correcting of a content having been already set). Meanwhile, when the mode for printing having been set is acceptable, the user selects and operates the "OK" button. Thus, the mode for printing having been set is stored in the memory unit 1201.

Figure 20:
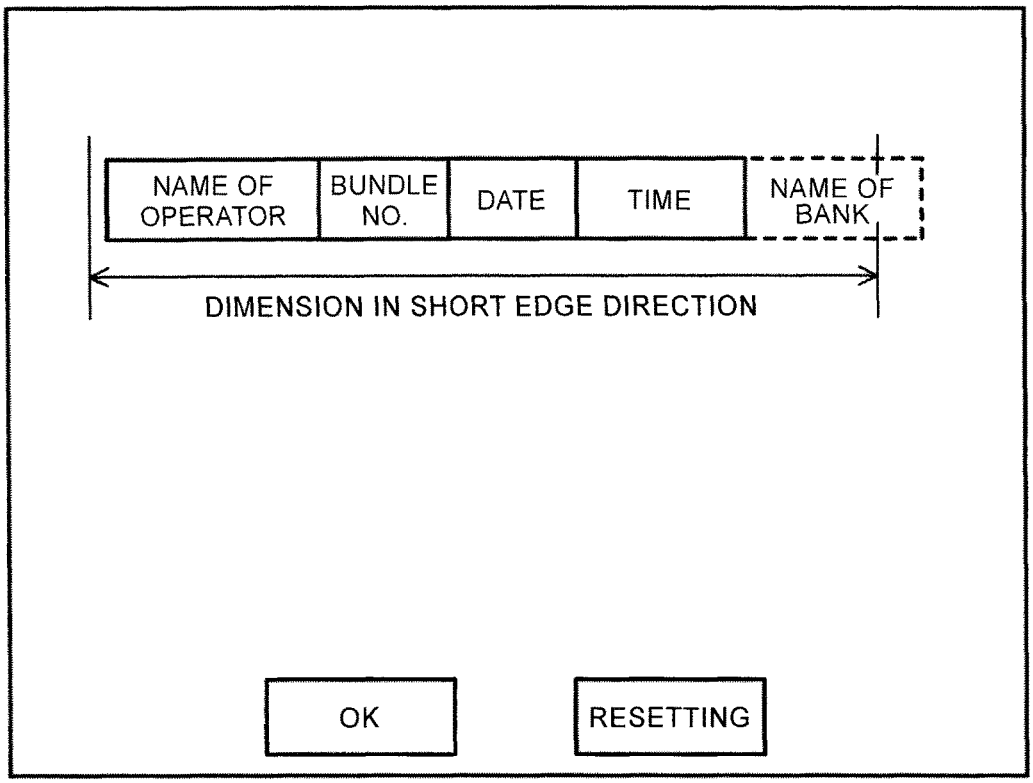
FIG. 20 illustrates an example of a screen on which a printing state is displayed when banknotes are bundled into bundled banknotes.

As described above, the number of digits for the items such as the bundle No., date, and time varies according to a time when the banknotes are bundled into the bundled banknotes, and the length for printing on the tape T may vary according thereto. As a result, as shown in FIG. 19, although a state of the printing on the tape T is previously confirmed when the mode for printing is set, a state of actual printing on the tape T for the bundled banknotes B may be different from the state of the printing displayed on the screen shown in FIG. 19. In the banknote handling apparatus 100, as shown in FIG. 20, also when the bundling is performed, a state of printing on the tape T is displayed on the touch panel 17. This state of printing may be displayed, for example, before banknotes are bundled into the bundled banknotes B for the first time after start of the bundling. Alternatively, each time banknotes are bundled into the bundled banknotes B, the state of printing for the bundled banknotes B may be displayed. In the illustrated example, since the dimension, in the short edge direction, of the banknotes to be bundled, is relatively short, "name of bank" is eliminated from items to be printed. An operator is allowed to confirm how the printing is actually performed for the bundled banknotes B to be obtained.

On the display screen, the "OK" button and the "resetting" button are also displayed. When the operator allows the state of printing on the tape T, the operator selects and operates the "OK" button. Thus, the banknote handling apparatus 100 performs printing on the tape T in the mode displayed on the screen and bundles banknotes into the bundled banknotes B. Thus, the bundled banknotes B in which necessary items are printed on only the tape portion positioned on the banknote face side or the banknote back side, without performing printing on the tape portion positioned on the small end surface of the bundled banknotes B, are obtained.

Meanwhile, when "resetting" button is selected and operated on the above-described screen, the operator is allowed to change the mode for printing. In the description herein, as the change of the mode for printing, for example, changing the order in which items, shown in FIG. 20, to be printed are arranged, replacing an item to be printed with another item, eliminating an item to be printed, and adding an item to be printed so as to fall within a range of the print portion, can be performed. Thus, the mode for printing can be changed, whereby desired items can be printed on the tape portion positioned on the banknote front side or the banknote back side of the bundled banknotes B. When the resetting is selected, bundling by the bundling unit 9 may be stopped until the resetting is completed.

Thus, in the banknote handling apparatus 100, the number of items to be printed on the tape T is increased or decreased, whereby the length for printing on the tape T is changed according to the dimension of the banknotes in the short edge direction. Thus, printing on the tape portion positioned on the small end surface of the bundled banknotes B for each of banknotes, of a plurality of denominations, having different dimensions in the short edge direction, is avoided, and printing on only the tape portion positioned on the banknote face side or the banknote back side, can be performed.

A user only sets items to be printed on the tape T and the priorities of the items, whereby the banknote handling apparatus 100 automatically sets items to be printed according to the dimension, in the short edge direction, of the banknotes. Therefore, usability is good. The priorities are set, whereby highly necessary items can be printed on the tape T also when an item to be printed is eliminated.

When narrowing of an empty space corresponding to the number of remaining characters or the number of remaining digits for an item, as well as eliminating of items to be printed according to the priorities having been set, is utilized, printing can be performed within a range of a predetermined print portion in the tape T for the bundled banknotes B without performing printing on the tape portion positioned on the small end surface even if the items to be printed are not eliminated, so that all the items selected by the user can be printed on the tape T. In the above-described configuration, eliminating of items to be printed according to the priorities having been set, and narrowing of an empty space corresponding to the number of remaining characters or the number of remaining digits for an item, are combined. However, the length for printing may be adjusted so as not to perform printing on the tape portion positioned on the small end surface, only by narrowing an empty space corresponding to the number of remaining characters or the number of remaining digits for an item.

Figure 21:
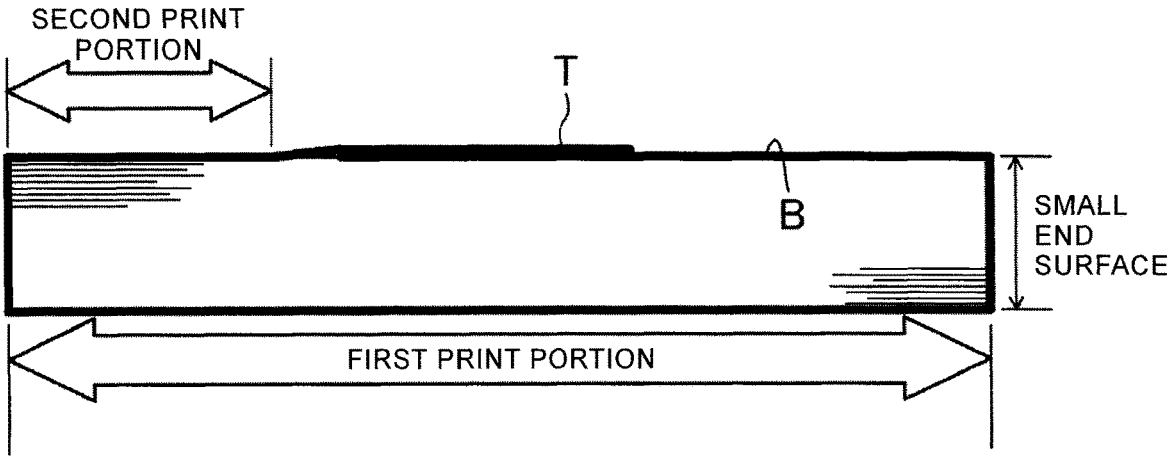
FIG. 21 illustrates a configuration in which print portions are provided on both the face side and the back side of the bundled banknotes.

In the above-described configuration, as shown in FIG. 15, the tape portion positioned on one of the banknote face side or the banknote back side of the bundled banknotes B is set as the print portion and the length for printing is changed so as to fall within this range. However, as shown in FIG. 21, in the bundled banknotes B, the tape portion positioned on the banknote face side may be set as a first print portion, and the tape portion positioned on the banknote back side may be set as a second print portion, and both the first and the second print portions may be set as the print portion. In the example shown in FIG. 21, the second print portion corresponds to one (left side in FIG. 21) of sides that sandwich therebetween a melt-adhered portion in the tape portion positioned on the back side. The second print portion is advantageously set as a portion that does not include the melt-adhered portion. The second print portion may be the other (right side in FIG. 21) of sides that sandwich therebetween the melt-adhered portion, or may be both the sides (the right side and the left side in FIG. 21) that sandwich therebetween the melt-adhered portion. Both the first and the second print portions are set as the print portion, whereby the range of the print portion is enlarged, and printing on the tape portion positioned on the small end surface can be prevented even if items to be printed are not eliminated. For example, on the screen for setting as shown in FIG. 18, the priorities of the respective items may be priorities according to which whether printing is to be performed on the first print portion or the second print portion is determined. For example, when the length for printing on the tape does not fit into the range of the first print portion, an item having a low priority may be printed on the second print portion.

Thus, when the length for printing falls within the range of the first print portion, printing is performed on only the first print portion (that is, one side printing mode), and when the length for printing does not fit into the range of the first print portion, printing is performed on both the first print portion and the second print portion (that is, both sides printing mode), according to the length for printing on the tape T and the dimension, in the short edge direction, of banknotes. When switching between the one side printing mode and the both sides printing mode is performed, items selected by the user can be printed on the tape as much as possible while printing on the tape portion positioned on the small end surface of the bundled banknotes B can be avoided.

Printing on both the first print portion and the second print portion, eliminating of items to be printed as described above, and/or narrowing of at least a part of an empty space for an item may be combined. That is, even when printing is performed on both the first print portion and the second print portion, the length, in the short edge direction, of the banknotes is limited. In particular, the second print portion is advantageously a portion that does not include melt-adhered portion of the tape T as described above, and the second print portion is relatively narrow. Therefore, even if printing on both the first and the second print portions is attempted, all the items selected by a user may not be printed in the range of the print portion. In this case, by eliminating of items to be printed and/or narrowing of at least a part of an empty space for an item as described above, printing as many items as possible on the first print portion and the second print portion can be performed without performing printing on the tape portion positioned on the small end surface of the bundled banknotes B.

The length for printing on the tape T may be adjusted by changing a font size for printing by the printing unit 97 instead of increasing or decreasing the number of items to be printed on the tape T. That is, when the font size is reduced, the length for printing can be shortened even if the number of items to be printed (that is, the number of characters to be printed) is the same. The banknote handling apparatus 100 may change the font size so as to allow all the selected items to fall within the range of the print portion, based on the dimension, in the short edge direction, of the bundled banknotes B. Thus, printing on the tape portion positioned on the small end surface of the bundled banknotes B can be avoided. The minimum font size may be preset in order to prevent the font size from being excessively small, and the length for printing may be further reduced by eliminating items to be printed or narrowing the empty space as described above when the length for printing does not fit into the range of the print portion even in the case of the minimum font size being used.

In the above-described configuration, a user sets items to be printed on the tape T and priorities thereof. However, when, for example, the denomination of banknotes to be bundled by the banknote handling apparatus 100 is restricted to several denominations in a range handled by the user (in general, banknotes to be bundled by the banknote handling apparatus 100 are currencies in the corresponding country, and the number of denominations thereof is not so large), items to be printed on the tape T for the bundled banknotes B may be preset for each denomination so as to fall within the print portion shown in FIG. 15 or FIG. 21. For example, as shown in FIG. 19, five items, "name of operator", "bundle No.", "date", "time", and "name of bank" are selected as items to be printed for the first denomination for which the dimension in the short edge direction is relatively long, while "name of operator", "bundle No.", "date", and "time" are selected for the second denomination for which the dimension in the short edge direction is relatively short, whereby items to be printed are reduced. The set items to be printed are stored in the memory unit 1201. Thus, based on a denomination of a banknote recognized by the recognition unit 3, items, to be printed, which are associated with the denomination are printed on the tape T, when banknotes are bundled into the bundled banknotes B. As a result, printing on the tape portion positioned on the small end surface of the bundled banknotes B can be avoided.

Instead of or in addition to setting items to be printed on the tape T for the bundled banknotes B for each denomination, whether or not an empty space corresponding to the number of remaining characters for an item is narrowed as described above, may be determined for each denomination, whereby the length for printing on the tape T may be set for each denomination.

A font size for printing on the tape T is set for each denomination, whereby the length for printing on the tape T may be set for each denomination.

Even when the length for printing on the tape T is set for each denomination, the length for printing may not fit into the range of the print portion as a result of varying of the number of digits for an item as described above. Therefore, also when the length for printing on the tape T is set for each denomination, setting of priorities of items to be printed, and/or narrowing of an empty space corresponding to the number of remaining characters, the number of remaining digits, or the like as described above, may be combined.

In a case where the length for printing is adjusted, when the length for printing does not fit into the range of the print portion, characters arranged outside the range of the print portion may not be printed, in addition to the number of items being increased or decreased, or the empty space being narrowed. That is, the number of characters to be printed may be decreased so as to fall within the range of the print portion.

The banknote handling apparatus 100 may switch, according to setting by a user, between prohibiting of printing on the tape portion positioned on the small end surface of the bundled banknotes B and allowing of printing on the tape portion positioned on the small end surface of the bundled banknotes B. In setting for prohibiting printing on the tape portion positioned on the small end surface, setting of the mode for printing as described above may be performed. Thus, usability of the banknote handling apparatus 100 is further enhanced.

As described above, the paper sheet handling apparatus disclosed herein includes a bundling unit, a printing unit, and a print setting unit. The bundling unit sets paper sheets of a plurality of kinds having different dimensions in the short edge direction, as objects to be bundled, stacks the same kind of paper sheets, and winds a tape therearound in the short edge direction, to bundle the paper sheets into bundled paper sheets. The printing unit sets, as a print portion, a tape portion positioned on the paper sheet face side or the paper sheet back side of the bundled paper sheets, and prints a content associated with the bundled paper sheets, on the print portion, along the tape. The print setting unit sets the length for printing on the tape, or a position at which printing on the tape is performed, based on the dimension, in the short edge direction, of paper sheets to be bundled, so as not to perform printing on the tape portion positioned on side surfaces of the bundled paper sheets.

In this configuration, the bundling unit bundles, as an object to be bundled, paper sheets of a plurality of kinds having different dimensions in the short edge direction. Therefore, the tape portion positioned on the paper sheet face side or the paper sheet back side of the bundled paper sheets, that is, the length of the print portion is different according to a kind of paper sheets to be bundled.

The print setting unit sets the length for printing on the tape, or a position at which printing on the tape is performed, based on the dimension, in the short edge direction, of the paper sheets to be bundled, in other words, based on the length of the print portion, so as not to perform printing on the tape portion positioned on the side surfaces of the bundled paper sheets.

The printing unit performs printing, for example, at a predetermined position in the tape which has not been wound around the paper sheets, over a predetermined length, according to the print position and the length for printing, which are set by the print setting unit. The printing unit may perform printing on the tape which has been wound around the paper sheets.

Thus, on the bundled paper sheets, printing is not performed on the tape portion on the side surfaces of the bundled paper sheets, and printing is performed on only the tape portion positioned on the paper sheet face side or the paper sheet back side.

The print setting unit may change the length for printing on the tape such that the length falls within a range of the print portion, based on the dimension, in the short edge direction, of the paper sheets to be bundled, and the printing unit may perform printing on the print portion according to the changed length for printing.

When the length for printing on the tape is changed so as to fall within the range of the print portion, based on the dimension, in the short edge direction, of the paper sheets to be bundled, printing is not performed on the tape portion positioned on the side surfaces of the bundled banknotes.

Changing of the length for printing includes changing of the length for printing by changing a font size for printing without changing a content and the number of characters to be printed.

Changing of the length for printing so as to fall within the range of the print portion also includes various configurations described below.

That is, a content to be printed on the tape includes a plurality of items, and the plurality of items may be printed on the print portion so as to be aligned along the tape, and the print setting unit may change the number of items to be printed on the tape such that the items fall within the range of the print portion.

The length for printing can be shortened by decreasing the number of items to be printed. Therefore, the number of items to be printed is adjusted based on the dimension, in the short edge direction, of the paper sheets to be bundled, whereby the length for printing on the tape can be changed so as to fall within the range of the print portion.

Priorities may be set for the plurality of items, respectively, and the print setting unit may eliminate, from items to be printed on the tape, an item having a low priority among the priorities such that the items fall within the range of the print portion.

Thus, an item having a high priority, in other words, an important item which is highly required to be printed is not eliminated and is printed on the tape, and an item which has a low priority and has low necessity for printing may be eliminated when the items do not fit into the range of the print portion. When the priorities are set, the highly required information is assuredly printed on the tape, while printing on the tape portion positioned on the side surfaces of the bundled paper sheets can be prevented. When the priorities are set, items to be printed on the tape can be automatically selected from among a plurality of items. The print setting unit can automatically change the length for printing.

The print setting unit may set priorities of the plurality of items based on an input operation from a user, and a display unit may display, when the user performs the input operation, a state in which the items are printed on the tape according to the set priorities, for the paper sheets of each of kinds having different dimensions in the short edge direction.

The user is a user who uses the paper sheet handling apparatus and is, in particular, a person in charge of setting of a content to be printed on the tape. In the above configuration, the user is allowed to optionally set the priorities of the plurality of items, and usability is improved.

When a user performs an input operation for setting the priorities, the display unit displays a state in which the items are printed on the tape according to the set priorities, for the paper sheets of each of kinds having different dimensions in the short edge direction. Thus, the user is allowed to confirm how the printing is performed on the tape of the bundled paper sheets according to the set priorities, for each paper sheet kind. As a result, the user is allowed to change the priorities which have been once set, according to need, and desired items for each paper sheet kind can be printed on the bundled paper sheets.

The content to be printed on the tape includes an item for which a user optionally sets a content within the preset maximum number of characters. When the number of characters set by the user is less than the maximum number of characters, the print setting unit may narrow at least a part of an empty space corresponding to the number of remaining characters for the item such that the content falls within the range of the print portion.

For example, the maximum number of characters is preset for the items such as a name of an operator and a name of a financial facility, and a user is allowed to optionally set a content within the maximum number of characters. When the number of characters set by the user is less than the maximum number of characters, although a space corresponding to the number of remaining characters may be included as a blank in the length for the item, at least a part of the empty space corresponding to the number of remaining characters is narrowed in the above configuration. The empty space may be entirely narrowed. Thus, the length of the item is shortened, whereby the length for printing on the tape can fall within the range of the print portion. In this configuration, a necessary content is printed as a content to be printed on the tape of the bundled paper sheets, while the length for printing on the tape is shortened, whereby printing on the tape portion positioned on the side surfaces of the bundled paper sheets may not be performed.

The content to be printed on the tape includes an item in which the number of digits varies within a predetermined maximum number of digits, and, when the number of digits to be printed is less than the maximum number of digits, the print setting unit may narrow at least a part of an empty space corresponding to the number of remaining digits for the item such that the content falls within the range of the print portion.

A specific example of the item in which the number of digits varies includes a serial number for the bundled paper sheets having been obtained. Further, time includes a single-digit time such as 1 o'clock, 2 o'clock, and 3 o'clock, and a double-digit time such as 11 o'clock, 12 o'clock, and 13 o'clock. Similarly, minute and second include single-digit minutes and seconds, and double-digit minutes and seconds. Therefore, a time at which the bundled paper sheets have been obtained, is also one of items in which the number of digits varies. For example, a day includes a single-digit day such as 1 and 2, and a double-digit day such as 11 and 12. Therefore, a date when the bundled paper sheets have been obtained is also one of items in which the number of digits varies.

For the item in which the number of digits varies, the maximum number of digits is preset. However, the number of digits to be printed on the tape may be less than the maximum number of digits. For example, when the maximum number of digits for the serial number is three, that the serial number is "1" means that the number of digits to be printed is less than the maximum number of digits. That the serial number "1" is represented as "001" also means that the number of digits to be printed is less than the maximum number of digits since the number of digits to be printed is substantially one. In this case, "00" of "001" can be regarded as the number of remaining digits. When the maximum number of digits for date is two, that date represents 1 (which also includes representation as "01 (day)") means that the number of digits to be printed is less than the maximum number of digits.

Thus, when the number of digits to be printed on the tape is less than the maximum number of digits, at least a part of an empty space corresponding to the number of remaining digits for the item is narrowed, whereby the length for printing can be shortened. As a result, a necessary content is printed as a content to be printed on the tape for the bundled paper sheets without performing printing on the tape portion positioned on the side surfaces of the bundled paper sheets.

The print setting unit may decrease the number of characters to be printed so as to fall within the range of the print portion.

In this configuration, when the total number of characters to be printed on the tape, is too large to fall within the range of the print portion, printing of the characters arranged outside the range of the print portion is forcibly prevented. Also in this configuration, printing on the tape portion positioned on the side surfaces of the bundled paper sheets can be prevented.

The print setting unit may switch, based on the dimension, in the short edge direction, of paper sheets to be bundled, between: the one side printing mode in which printing on the tape portion positioned on one of the paper sheet face side or the paper sheet back side is performed; and the both sides printing mode in which printing on each of the tape portion positioned on the paper sheet face side and the tape portion positioned on the paper sheet back side, is performed, and the printing unit may perform printing on the tape according to the printing mode.

In this configuration, when the length for printing is long and does not fit into the range of the tape portion positioned on one of the paper sheet face side or the paper sheet back side, the mode is switched to the both sides printing mode. Thus, printing is performed on each of the tape portion positioned on the paper sheet face side and the tape portion positioned on the paper sheet back side, whereby the range of the print portion is enlarged. As a result, while a necessary content is printed on the tape, printing on the tape portion positioned on the side surfaces of the bundled paper sheets can be avoided.

The print setting unit may set the length for printing on the tape such that the length for printing falls within the range of the print portion according to the dimensions, in the short edge direction, of a plurality of kinds of paper sheets to be bundled, and the printing unit may perform printing on the print portion, according to the length for printing which is set by the print setting unit, based on the kind of paper sheets to be bundled.

Thus, when the length for printing on the tape is set according to the dimensions, in the short edge direction, of a plurality of kinds of paper sheets to be bundled, printing on the print portion is performed according to the set length for printing based on the kind of the paper sheets to be bundled, whereby a necessary content can be printed on the tape, and printing on the tape portion positioned on the side surfaces of the bundled paper sheets is not performed.

The length for printing on the tape may be set: by setting items to be printed according to the dimensions, in the short edge direction, of the plurality of kinds of paper sheets; by narrowing at least a part of an empty space corresponding to the number of remaining characters among the maximum number of digits, according to the dimensions, in the short edge direction, of a plurality of kinds of paper sheets; or by setting a font size according to the dimensions, in the short edge direction, of a plurality of kinds of paper sheets, as described above.

The print setting unit may display, on the display unit, a state where printing on the tape of the bundled paper sheets is performed, when the bundling unit bundles paper sheets into the bundled paper sheets.

When the bundling unit bundles paper sheets into the bundled paper sheets, the display unit indicates how the printing on the tape for the bundled paper sheets is performed, whereby the user is allowed to recognize the printing state.

The print setting unit may be configured so as to allow a user to change a mode for printing based on the displayed printing state.

A user may determine that the mode for printing needs to be changed as a result of the printing state being recognized. In this case, the user is allowed to change the mode for printing, whereby printing on the tape for the bundled paper sheets in a desired printing state can be performed.

The print setting unit may switch, based on an input operation from a user, between a mode in which printing on the tape portion positioned on the side surfaces of the bundled paper sheets is prohibited, and a mode in which printing on the tape portion positioned thereon is allowed, and the printing unit may perform printing on the tape according to the mode.

Thus, a user is allowed to optionally switch the mode for printing on the tape, thereby improving usability of the paper sheet handling apparatus.

Other Embodiments

The above embodiments have been described as an example of the technique disclosed in the present application. However, the technique in the present disclosure is not limited to the embodiments, but is also applicable to embodiments which are altered or substituted, to which other features are added, or from which some features are omitted, as needed. Optionally, the components described in the embodiments may be combined to create a new embodiment. The components illustrated on the accompanying drawings and described in the detailed description include not only essential components that need to be used to overcome the problem, but also other unessential components that do not have to be used to overcome the problem and that are used for illustrating the technique. Therefore, such unessential components should not be taken for essential ones, simply because such unessential components are illustrated in the drawings or mentioned in the detailed description.

The embodiment may have the following configuration.

In the above embodiment, as an example of the paper sheet handling apparatus, the banknote handling apparatus 100 is described. The paper sheet handling apparatus is not limited thereto. For example, recognition, distribution, and stacking of the paper sheets may be performed by another device, and the paper sheet handling apparatus may be an apparatus that merely performs an operation of transporting loose paper sheets and stacking the paper sheets in the stacking unit, and bundling the paper sheets stacked in the stacking unit. Further, the paper sheet handling apparatus may be an apparatus that allows a person to manually insert the stacked paper sheets into the large tape loop L2 in a separate manner, and that bundles the paper sheets. The technique disclosed herein is widely applicable to an apparatus configured to bundle paper sheets with a tape. Banknotes are described as an example of paper sheets. However, the paper sheets are not limited to banknotes, and may be cash vouchers such as gift coupons.

The above-described configuration of the banknote handling apparatus 100 is an example, and the configuration thereof is not limited thereto. For example, the banknote handling apparatus 100 may be configured to bundle banknotes without forming a tape loop when banknotes are bundled.

DESCRIPTION OF THE REFERENCE CHARACTERS

100 banknote handling apparatus (paper sheet bundling apparatus)
1002 operation unit power switch
1003 temperature sensor
1004 humidity sensor
912 tape transport unit
9111 reel (reel unit)
9112 reel base (reel unit)
92 tape loop forming unit (tape bundling unit)
9211 second tape sensor (sensor)
B banknotes (paper sheets)
L tape loop
L1 small tape loop
L2 large tape loop
T tape
TR tape roll

The invention claimed is:

1. A paper sheet bundling apparatus comprising:

a tape bundling unit having a holding unit, and configured to bundle stacked paper sheets with a tape held by the holding unit;

a reel unit in which a tape roll is set, the reel unit configured to be arranged above the tape bundling unit with respect to a vertical direction and configured to allow a motor to rotate the tape roll in a feeding direction in which the tape is fed and in a winding direction in which the tape is wound;

a tape transport unit having a pair of rollers sandwiching the tape and a transport path provided between the reel unit and the tape bundling unit with respect to the vertical direction, the tape transport unit configured to allow the pair of rollers to transport the tape drawn from the tape roll to the tape bundling unit when the tape bundling unit performs bundling, the tape transport unit configured to cause the tape to be in a stand-by state in which the tape is arranged along the transport path when the tape bundling unit does not perform bundling; and a paper sheets transport unit having an arm for transporting the stacked paper sheets to the tape bundling unit, wherein the reel unit is disposed in an upper portion of a housing of the paper sheet bundling apparatus, and the tape transport unit transports the tape downward from the reel unit with respect to the vertical direction, when the tape bundling unit does not perform bundling, the reel unit performs a specific operation of rotating the tape roll in the feeding direction at a predetermined time to reduce tensile force in the tape with respect to the vertical direction, the tape bundling unit forms a small tape loop by using the tape fed from the reel unit, and the small tape loop is thereafter enlarged in the vertical direction by the tape being fed from the reel unit to form a large tape loop, before the paper sheets transport unit transports the stacked paper sheets to the tape bundling unit, the paper sheets transport unit transports the stacked paper sheets into the large tape loop by the arm, and the tape bundling unit bundles the stacked paper sheets by reducing the size of the large tape loop.

2. A paper sheet bundling apparatus comprising:

a tape bundling unit having a holding unit, and configured to bundle stacked paper sheets with a tape held by the holding unit;

a reel unit in which a tape roll is set, the reel unit configured to be arranged above the tape bundling unit with respect to a vertical direction and configured to allow a motor to rotate the tape roll in a feeding direction in which the tape is fed and in a winding direction in which the tape is wound;

a tape transport unit having a pair of rollers sandwiching the tape and a transport path provided between the reel unit and the tape bundling unit with respect to the vertical direction, the tape transport unit configured to allow the pair of rollers to transport the tape drawn from the tape roll to the tape bundling unit when the tape bundling unit performs bundling, the tape transport unit configured to cause the tape to be in a stand-by state in which the tape is arranged along the transport path when the tape bundling unit does not perform bundling; and a paper sheets transport unit having an arm for transporting the stacked paper sheets to the tape bundling unit, wherein the reel unit is disposed in an upper portion of a housing of the paper sheet bundling apparatus, and the tape transport unit transports the tape downward from the reel unit with respect to the vertical direction, when the tape bundling unit does not perform bundling, the tape transport unit performs, at a predetermined timing, a specific operation of transporting the tape in a direction in which the tape is wound back to the reel unit to reduce tensile force in the tape with respect to the vertical direction, the tape bundling unit forms a small tape loop by using the tape fed from the reel unit, and the small tape loop is thereafter enlarged in the vertical direction by the tape being fed from the reel unit to form a large tape loop, before the paper sheets transport unit transports the stacked paper sheets to the tape bundling unit, the paper sheets transport unit transports the stacked paper sheets into the large tape loop by the arm, and the tape bundling unit bundles the stacked paper sheets by reducing the size of the large tape loop.

3. A paper sheet bundling apparatus comprising:

a tape bundling unit having a holding unit, and configured to bundle stacked paper sheets with a tape by the holding unit;

a reel unit in which a tape roll is set, the reel unit configured to be arranged above the tape bundling unit with respect to a vertical direction and configured to allow a motor to rotate the tape roll in a feeding direction in which the tape is fed and in a winding direction in which the tape is wound;

a tape transport unit having a pair of rollers sandwiching the tape and a transport path provided between the reel unit and the tape bundling unit with respect to the vertical direction, the tape transport unit configured to allow the pair of rollers to transport the tape drawn from the tape roll to the tape bundling unit when the tape bundling unit performs bundling, the tape transport unit configured to cause the tape to be in a stand-by state in which the tape is arranged along the transport path when the tape bundling unit does not perform bundling; and a paper sheets transport unit having an arm for transporting the stacked paper sheets to the tape bundling unit, wherein when the tape bundling unit does not perform bundling, the reel unit performs, at a predetermined timing, a specific operation of transporting the tape in the feeding direction to the tape bundling unit or in a direction in which the tape is wound back to the reel unit to perform a specific operation of changing a stand-by position of the tape with respect to the vertical direction, the tape bundling unit forms a small tape loop by using the tape fed from the reel unit, and the small tape loop is thereafter enlarged in the vertical direction by the tape being fed from the reel unit to form a large tape loop, before the paper sheets transport unit transports the stacked paper sheets to the tape bundling unit, the paper sheets transport unit transports the stacked paper sheets into the large tape loop by the arm, and the tape bundling unit bundles the stacked paper sheets by reducing the size of the large tape loop.

4. The paper sheet bundling apparatus according to claim 1, wherein the reel unit executes the specific operation when a predetermined time period has elapsed in a state where the tape bundling unit does not bundle the paper sheets.

5. The paper sheet bundling apparatus according to claim 1, wherein the reel unit executes the specific operation when the tape bundling unit has completed bundling of the paper sheets.

6. The paper sheet bundling apparatus according to claim 1, wherein the reel unit executes the specific operation when one transaction in which the tape bundling unit performs bundling of the paper sheets has ended.

7. The paper sheet bundling apparatus according to claim 1, wherein, the tape transport unit transports the tape drawn from the tape roll, in a direction in which the tape is fed toward the tape bundling unit, when the tape roll is set in the reel unit, to arrange the tape continuously along the transport path, and the reel unit executes the specific operation when the tape roll is set in the reel unit.

8. The paper sheet bundling apparatus according to claim 1, wherein the reel unit executes the specific operation when a power supply is switched off.

9. The paper sheet bundling apparatus according to claim 1, wherein at least one of a sensor that detects an ambient temperature and a sensor that detects an ambient humidity, is provided, and the reel unit sets the predetermined time at which the specific operation is executed, based on a result of detection by each sensor.

10. A paper sheet bundling apparatus comprising:

a tape bundling unit having a holding unit, and configured to bundle stacked paper sheets with a tape held by the holding unit;

a reel unit in which a tape roll is set, the reel unit configured to be arranged above the tape bundling unit with respect to a vertical direction and configured to allow a motor to rotate the tape roll in a feeding direction in which the tape is fed and in a winding direction in which the tape is wound;

a tape transport unit having a pair of rollers sandwiching the tape and a transport path provided between the reel unit and the tape bundling unit with respect to the vertical direction, the tape transport unit configured to allow the pair of rollers to transport the tape drawn from the tape roll to the tape bundling unit when the tape bundling unit performs bundling, the tape transport unit configured to cause the tape to be in a stand-by state in which the tape is arranged along the transport path when the tape bundling unit does not perform bundling; and a paper sheets transport unit having an arm for transporting the stacked paper sheets to the tape bundling unit, wherein before the tape is supplied to the tape bundling unit, the tape transport unit performs at least one reciprocate movement to reciprocate the tape, thereby correcting deformation included in the tape while no bundling is performed, the tape bundling unit forms a small tape loop by using the tape fed from the reel unit, and the small tape loop is thereafter enlarged in the vertical direction by the tape being fed from the reel unit to form a large tape loop, before the paper sheets transport unit transports the stacked paper sheets to the tape bundling unit, the paper sheets transport unit transports the stacked paper sheets into the large tape loop by the arm, and the tape bundling unit bundles the stacked paper sheets by reducing the size of the large tape loop.

11. A paper sheet bundling apparatus comprising:

a tape bundling unit configured to bundle stacked paper sheets with a tape;

a reel unit in which a tape roll is set, the reel unit configured to rotate the tape roll in a feeding direction in which the tape is fed, and a winding direction in which the tape is wound; and a tape transport unit having a transport path provided between the reel unit and the tape bundling unit, the tape transport unit configured to transport the tape drawn from the tape roll, along the transport path, to supply the tape to the tape bundling unit when the tape bundling unit performs bundling, the tape transport unit configured to cause the tape to be in a stand-by state in which the tape is arranged continuously along the transport path when the tape bundling unit does not perform bundling, wherein the tape bundling unit forms, the tape supplied by the tape transport unit into a tape loop, and bundles the paper sheets by inserting the stacked paper sheets into the tape loop, characterised in that the tape bundling unit further includes a sensor that detects whether or not the tape loop having a predetermined shape has been formed, and the tape bundling unit forms the tape loop again when the tape loop having the predetermined shape is not formed, based on a result of detection by the sensor, and the tape bundling unit further performs forming of the tape loop for a predetermined number of times regardless of a result of detection by the sensor, when starting bundling of the paper sheets after a state where bundling is not performed has continued for a predetermined time period or longer period.

12. The paper sheet bundling apparatus according to claim 3, wherein the reel unit executes the specific operation when a predetermined time period has elapsed in a state where the tape bundling unit does not bundle the paper sheets.

13. The paper sheet bundling apparatus according to claim 3, wherein the reel unit executes the specific operation when the tape bundling unit has completed bundling of the paper sheets.

14. The paper sheet bundling apparatus according to claim 3, wherein the reel unit executes the specific operation when one transaction in which the tape bundling unit performs bundling of the paper sheets has ended.

15. The paper sheet bundling apparatus according to claim 3, wherein, the tape transport unit transports the tape drawn from the tape roll, in a direction in which the tape is fed toward the tape bundling unit, when the tape roll is set in the reel unit, to arrange the tape continuously along the transport path, and the reel unit executes the specific operation when the tape roll is set in the reel unit.

16. The paper sheet bundling apparatus according to claim 3, wherein the reel unit executes the specific operation when a power supply is switched off.

17. The paper sheet bundling apparatus according to claim 3, wherein at least one of a sensor that detects an ambient temperature and a sensor that detects an ambient humidity, is provided, and the reel unit sets the predetermined time at which the specific operation is executed, based on a result of detection by each sensor.

18. The paper sheet bundling apparatus according to claim 10, wherein the tape transport unit transports the tape arranged in the transport path in the feeding direction to the tape bundling unit or in a direction in which the tape is wound back to the reel unit to perform at least one reciprocate movement.

* * * * *